US010092125B1

(12) United States Patent
Braunberger

(10) Patent No.: US 10,092,125 B1
(45) Date of Patent: Oct. 9, 2018

(54) STAND THAT HOLDS AN ITEM OR OBJECT IN AN UPRIGHT MANNER

(71) Applicant: Benjamin A. Braunberger, Fond du Lac, WI (US)

(72) Inventor: Benjamin A. Braunberger, Fond du Lac, WI (US)

( * ) Notice: Subject to any disclaimer, the term of this patent is extended or adjusted under 35 U.S.C. 154(b) by 0 days.

(21) Appl. No.: 15/431,282

(22) Filed: Feb. 13, 2017

Related U.S. Application Data

(60) Provisional application No. 62/295,900, filed on Feb. 16, 2016.

(51) Int. Cl.

| | |
|---|---|
| ***F16M 13/00*** | (2006.01) |
| ***A47G 33/12*** | (2006.01) |
| ***F16M 11/24*** | (2006.01) |
| ***F16M 11/32*** | (2006.01) |

(52) U.S. Cl.
CPC ..... *A47G 33/12* (2013.01); *F16M 11/242* (2013.01); *F16M 11/32* (2013.01); *A47G 2033/1266* (2013.01)

(58) Field of Classification Search
CPC .. F16M 11/242; F16M 11/00; F16M 11/2014; F16M 11/245
See application file for complete search history.

(56) References Cited

U.S. PATENT DOCUMENTS 5,072,910 A * 12/1991 May ..... F16M 11/28 248/170
2006/0049319 A1* 3/2006 May ..... G10D 13/026 248/166
2013/0042745 A1* 2/2013 Shimada ..... F16M 11/245 84/421

* cited by examiner

*Primary Examiner* — Amy J. Sterling
(74) *Attorney, Agent, or Firm* — Brannen Law Office, LLC

(57) ABSTRACT

The present invention relates to a stand for holding an item in an upright or vertical manner. The stand can have a shaft. A top cradle and a bottom cradle are provided and are pressed against the object being held. The top cradle is at or near a first end of the shaft, and can be adjustable vertically, rotatably and perpendicularly (distance from the shaft). Two brackets cooperate to form the lower or bottom cradle. The upper and lower cradles are separated by a distance. The two brackets also adjustably support at least three legs in a pivotable manner. Each bracket has at least one section having a leg pivot and at least one deployment hole. Three deployment holes arranged in an arc can be provided. Studs are provided for securement into a selected deployment hole.

19 Claims, 36 Drawing Sheets

$d_x$ = NORMAL DISTANCE $d_1 = d_2 = d_3 = d_4$ $L_x$ = LEG LENGTH $L_1 = L_4$ $L_2 = L_3$

FIG. 31
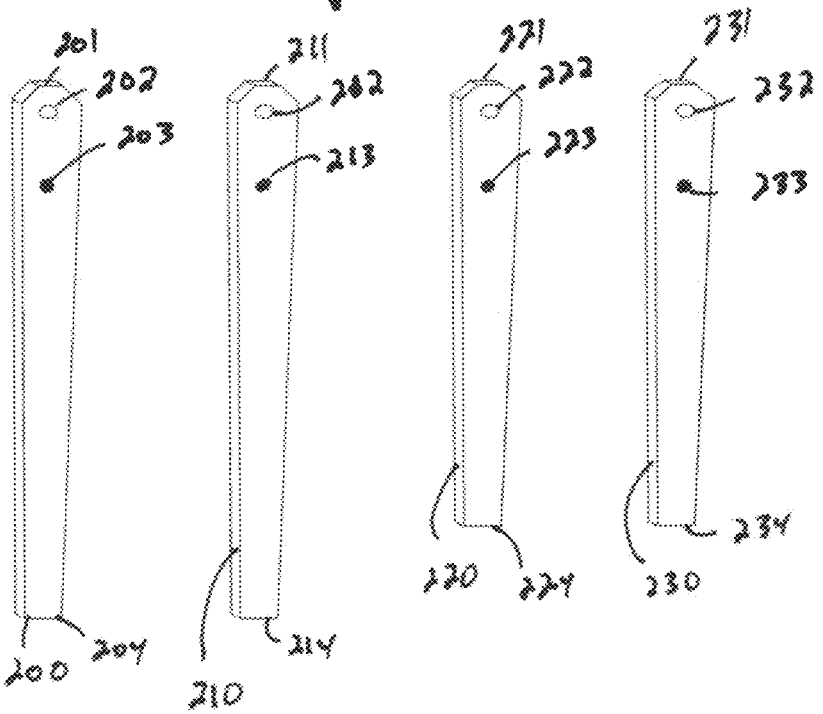
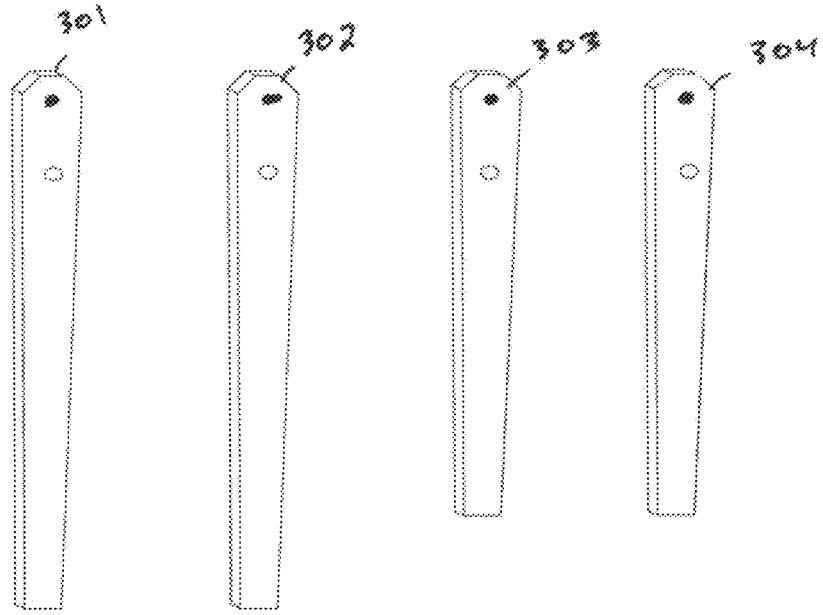
FIG. 32

STAND THAT HOLDS AN ITEM OR OBJECT IN AN UPRIGHT MANNER

This patent application claims priority on and the benefit of provisional application 62/295,900 filed Feb. 16, 2016, the entire contents of which are hereby incorporated herein by reference.

BACKGROUND OF THE INVENTION

1. Field of the Invention

The present invention relates to a stand for holding an item in an upright or vertical manner, and in particular to a stand having a plurality of adjustable legs and a securing device.

2. Description of the Related Art

Many stands are in existence. Some, in the field of trees, are described below.

A typical tree stand for a cut tree has a base with legs that extend from the base in a fixed manner. Then, pins, screws or other types of anchoring devices are driven into or pressed against the trunk of the tree to maintain its alignment within the stand. The anchoring devices may not be effective if the wood is particularly soft or if the anchoring devices are not sufficiently driven into or pressed against the trunk. Sometimes, a bottom spike is provided. However, it can be difficult to drive the tree onto the spike where it can provide a stabilizing effect. Still further, devices of this type require that a floor or other base surface be flat and level.

Thus there exists a need for a stand that holds an item or object in an upright or vertical manner that solves these and other problems.

SUMMARY OF THE INVENTION

The present invention relates to a stand for holding an item in an upright or vertical manner, and in particular to a tree stand. The stand can have a shaft that is generally vertically aligned. A top cradle and a bottom cradle are provided and are pressed against the object being held. The top cradle is at or near a first end of the shaft, and can be adjustable vertically, rotatably and perpendicularly (distance from the shaft). Two brackets cooperate to form the lower or bottom cradle. The upper and lower cradles are separated by a distance. The two brackets also adjustably support at least three legs in a pivotable manner. Each bracket has at least one section having a leg pivot and at least one deployment hole. Three deployment holes arranged in an arc can be provided. Studs can be provided for securement into a selected deployment hole in the respective bracket so that the respective leg is held in a selected angular alignment relative to the shaft.

According to one advantage of the present invention, the stand is strong, stable and light weight.

According to another advantage of the present invention, the stand has multiple cradles that receive an item with a vertical or upright portion such as a tree trunk. A securing element (which is a part of a securement device), such as a chain or strap is then used to secure the item to the stand within the cradles. The cradles prevent swaying of the tree.

According to a further advantage of the present invention, the upper cradle, lower cradle and the securement device provide multiple points (three preferred) of engagement between the stand and the device being held. The points are vertically separated by a selected distance thereby providing a secure connection to prevent swaying between the object being held and the stand.

According to a further advantage of the present invention, external engagement points eliminate problems associated with driving screws or other elements into or against a soft tree.

According to a further advantage of the present invention, the stand has a securement device positioned between the upper and lower cradles and having a turning element, a threaded element and a securing element. The securement device is useful with trees having trunks of various diameters. The threaded element allows for a range of useful diameters, wherein the turning element is useful to tighten the securing element whereby the tree trunk is tightly engaged.

According to another advantage of the present invention, the cradles have diverging faces or pieces that allow objects of various shapes and sizes to be seated or held within the cradles.

According to a still further advantage of the present invention, at least three legs are provided wherein the legs provide a stable base for the stand.

According to a still further advantage yet of the present invention, the normal distance from the geometric center of an object being held to the lines between each two adjacent legs is approximately equal. It is appreciated that in an embodiment having four legs (as compared to three legs), that the normal distance is increased. Increasing the normal distance improves stability of the object being held.

According to a still further advantage yet of the present invention, each leg can have a storage position and at least one deployment position. In a preferred embodiment, each leg has a plurality of deployment positions. This advantageously allows the legs to have variable angular positions relative to the base. In one instance where three deployment positions are provided, this allows the legs to be aligned to a narrow, an intermediate and a wide position relative to stabilizing or resting points on the floor. The wide position can be used with taller (often wider and heavier) trees wherein more stability is provided. Yet, the legs can remain within the outer perimeter of the lower end of the tree. The narrower position can be used with a shorter (often narrower and lighter) tree where a smaller footprint is desired and less stability is needed. In another instance, each leg could be held at a different angle relative to the shaft in order to accommodate an uneven floor or surface upon which the stand is resting upon.

According to an advantage of an alternative embodiment of the present invention, legs with extensions can be provided wherein each leg has a length that is adjustable. This advantageously allows the stand to be finely leveled upon a surface, especially an uneven surface.

In one embodiment of the present invention, studs attached to legs are provided for being received within specific holes in the brackets to hold the legs in the desired positions. Elongated fasteners can be used to secure the legs to the brackets whereby the fasteners are not fully removed to change the hole in which the studs engage.

According to a still further advantage of the present invention, there can be two storage positions of the legs. In one position, the legs are pivoted towards the top cradle for a compact storage position. In a second position, the legs are deployed away from the top cradle wherein they are approximately parallel to but offset from the shaft longitudinal axis. The second position is useful wherein the stand can be transported while secured to a tree. In the first position, the securement device can be used to hold the legs in place. In the second position, the studs can be placed into holes in the respective brackets to lock the legs in place. The stand can be changed from the second storage position to a deployed position while it is secured to a trunk of a tree or other device.

According to a further advantage of the present invention, the legs extend approximately radially from the bottom end of the shaft. Each leg is pivotable about a point that is offset from the longitudinal axis of the shaft.

According to a still further advantage of the present invention, the legs can have different lengths whereby in any given position (narrow, intermediate or wide), the geometric center between the distal ends of the legs is a point that is slightly offset from the shaft longitudinal axis. This offset distance is approximately equal to the distance between the center of gravity of an average sized tree held by the stand and the center line of the shaft.

According to a still further advantage of the present invention, the user can use any desired fluid reservoir with the present invention that can fit under the legs and that can contain or receive the trunk of the tree or another object.

According to an advantage of an alternative embodiment, an upper cradle can be adjustable in vertical, radial and perpendicular travel (relative to the shaft) manners. In this regard, the cradle is adjustable and useful to overcome challenges presented by variance in the natural physical dimensions of trees or other objects.

According to a further advantage of this alternative embodiment, this multi-direction adjustability is locked in position with respect to the shaft at a single location or interface.

According to an advantage of one example of the multi-adjustable upper cradle, a collar can be provided that allows for the horizontal adjustment also is a travel limiter to prevent the collar from being removed from the holder.

According to a further advantage of another example of an upper cradle, a fork can be provided having two parallel rods or bars joined in a separated manner at one end. The fork can be installed through holes in the block and then can be formed or made into divergent segments to create the cradle.

According to an advantage of another example of the multi-adjustable upper cradle, a holder can be comprised of a block having slotted or oversized through holes allowing a fork to laterally move under force from a lock within the dimension of the slots or oversized holes.

Other advantages, benefits, and features of the present invention will become apparent to those skilled in the art upon reading the detailed description of the invention and studying the drawings.

BRIEF DESCRIPTION OF THE DRAWINGS

FIG. 31 is a view showing the legs illustrated in FIG. 7.

FIG. 32 is a view showing the legs illustrated in FIG. 7A.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
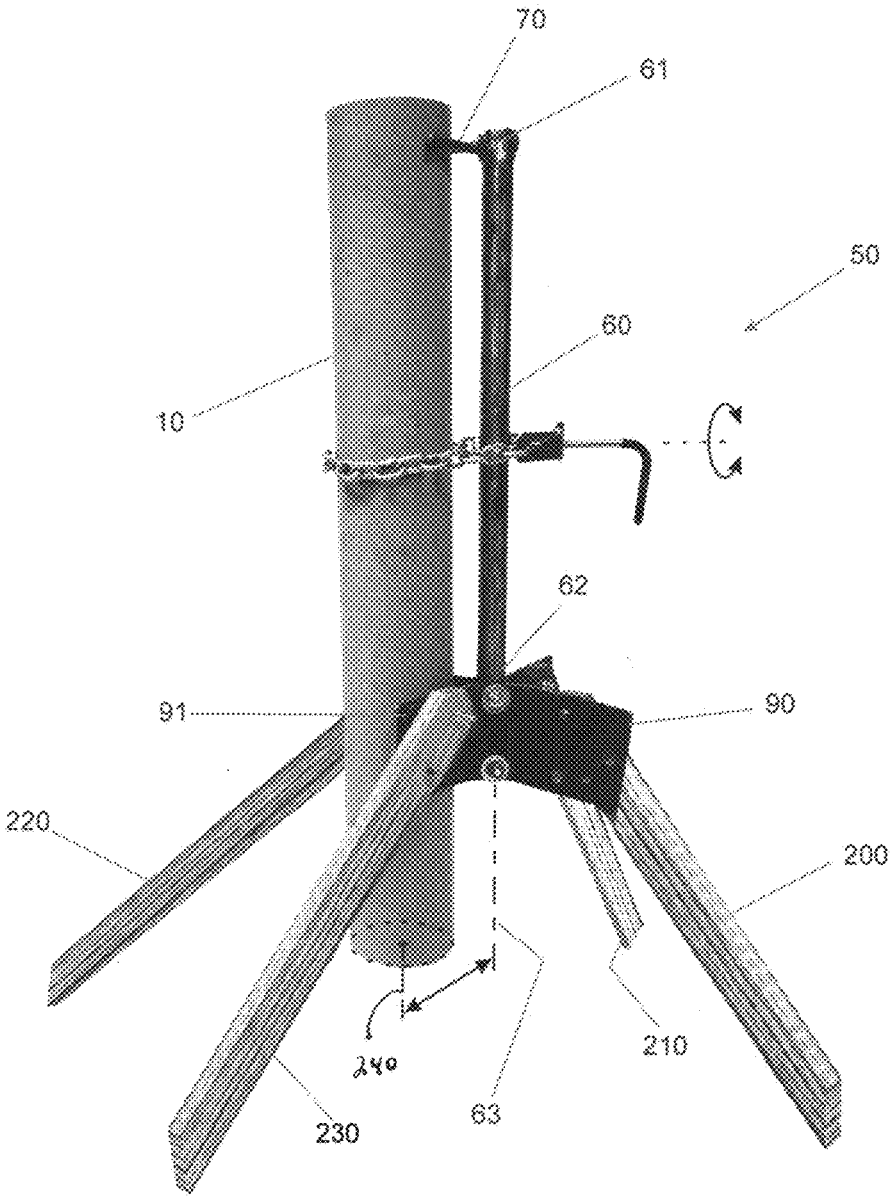
FIG. 1 is a perspective view showing the stand holding an object in a vertical or upright manner.
Figure 2:
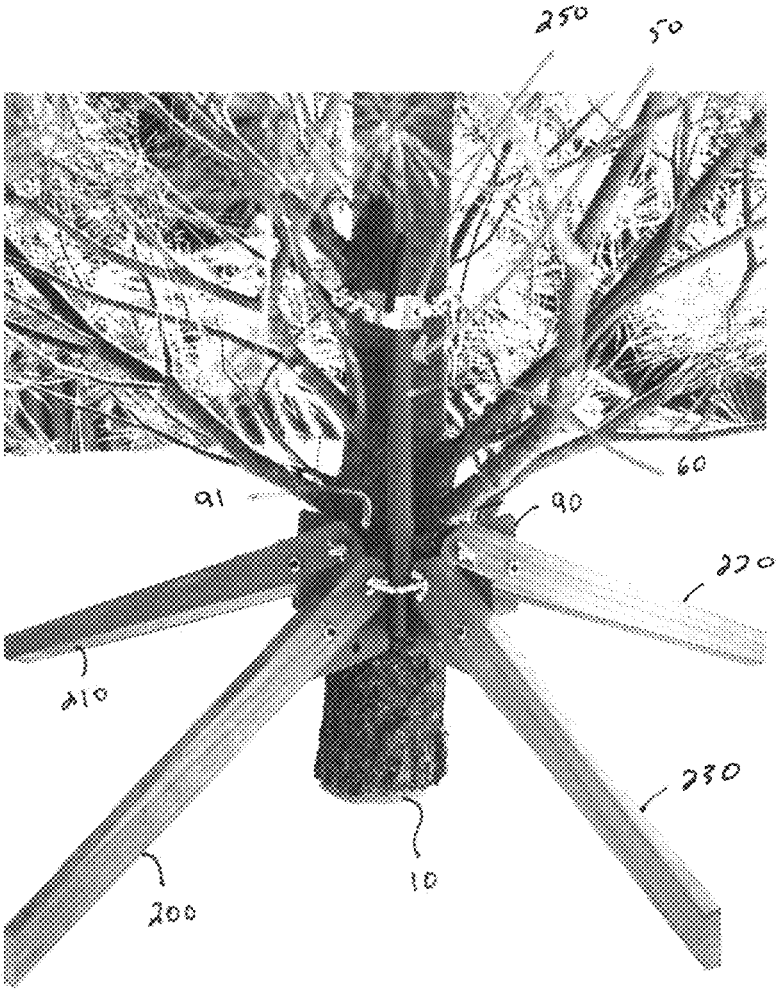
FIG. 2 is a perspective view showing the stand holding a cut tree in an upright or vertical manner and showing a first embodiment of a securement device.
Figure 3:
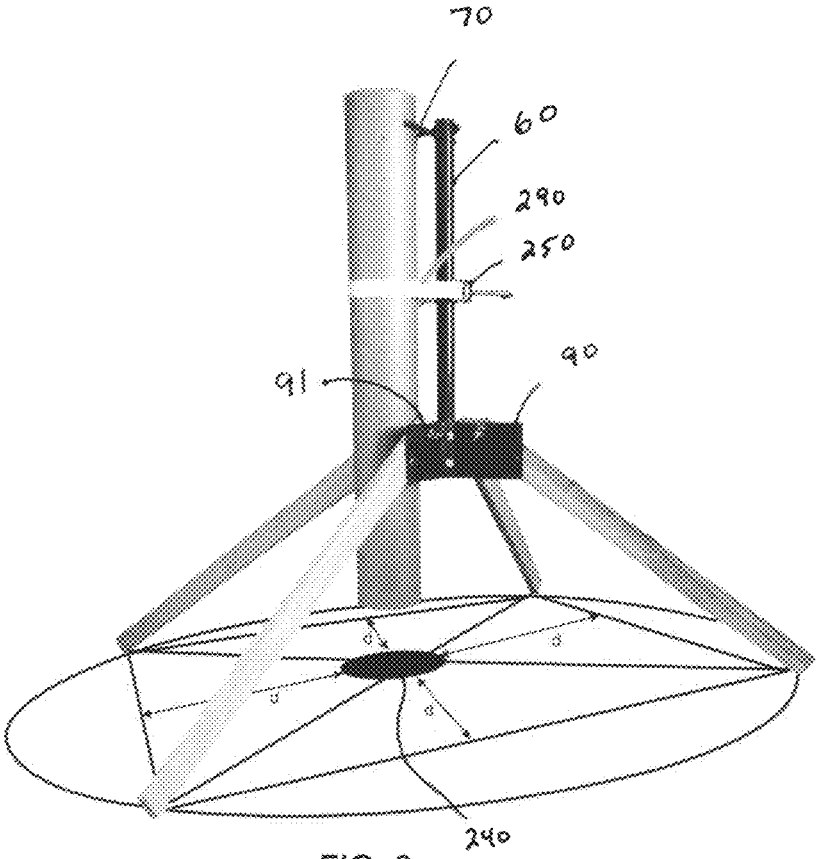
FIG. 3 is a perspective view of a preferred embodiment of the present invention incorporating a second embodiment of a securement device.

Looking first at FIGS. 1-3, it is seen that a stand 50 is provided. The stand 50 is useful for holding a device 10 or object in a vertical manner. The device 10 can be any object, but preferably is an object having a shaft with a longitudinal axis. One exemplary example is a cut tree having a trunk. The invention is useful with objects having a range of diameters and can be sized for use with a range and a preferred diameter size.

Figure 5:
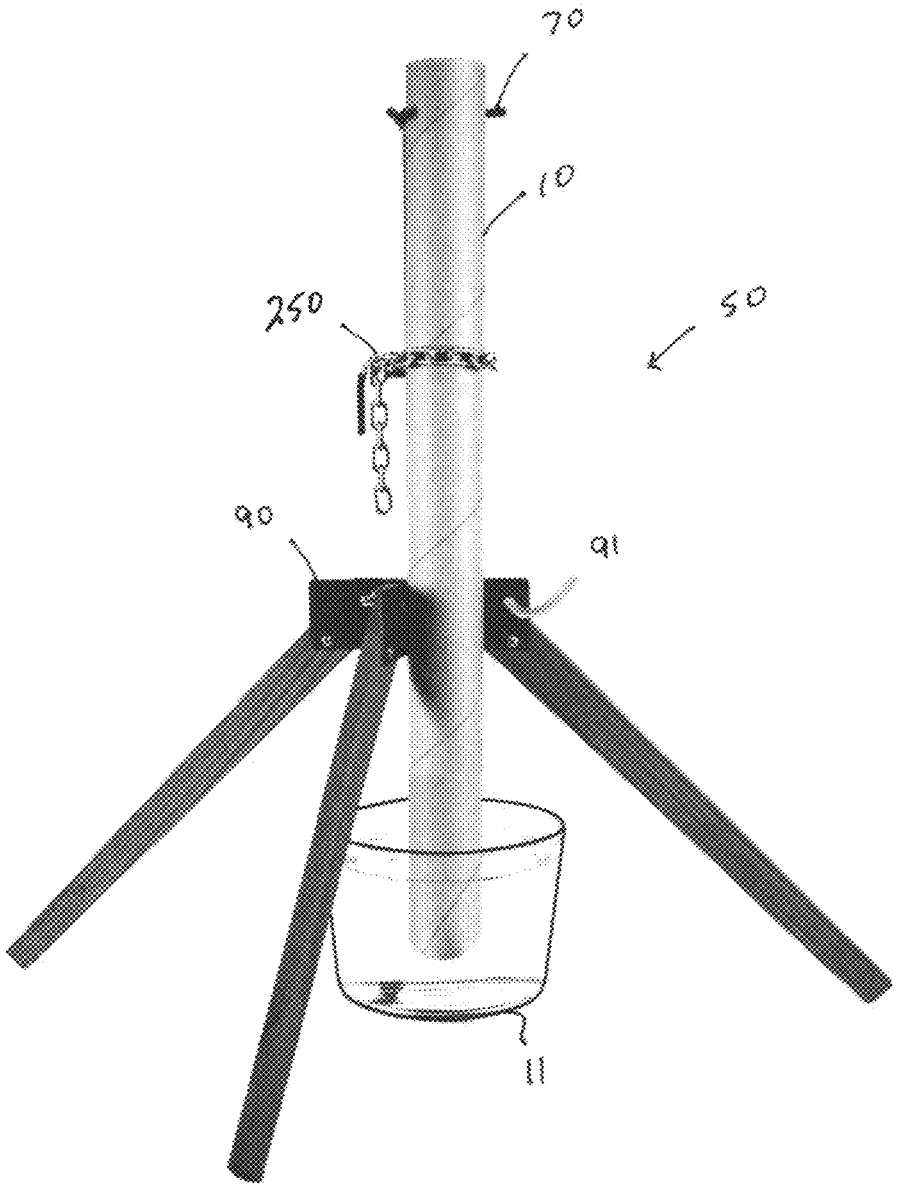
FIG. 5 is a perspective view of one example of a preferred embodiment of the present invention showing a reservoir shown tranparently in place under an object.

Looking now briefly at FIG. 5, it is seen that the stand is useful to hold a bottom end of the object 10 adjacent the ground and within a reservoir 11 that rests on the floor or ground. This is of use when the stand is supporting a cut tree.

Looking now at FIGS. 1 and 5-20, it is seen that the stand comprises a shaft 60, a top cradle 70, a bottom cradle 91, a plurality of legs 200, 210, 220 and 230, and a securement device 250. Each of the components is described below.

The shaft 60, as seen in FIGS. 1 and 3, has a first end (top) 61 and a second end (bottom) 62. The shaft is preferably linearly oriented and has a longitudinal axis 63. In one embodiment, the shaft is made of metal (solid or tubular). However, it is appreciated that other strong and suitable materials could be used without departing from the broad aspects of the present invention.

Figure 6:
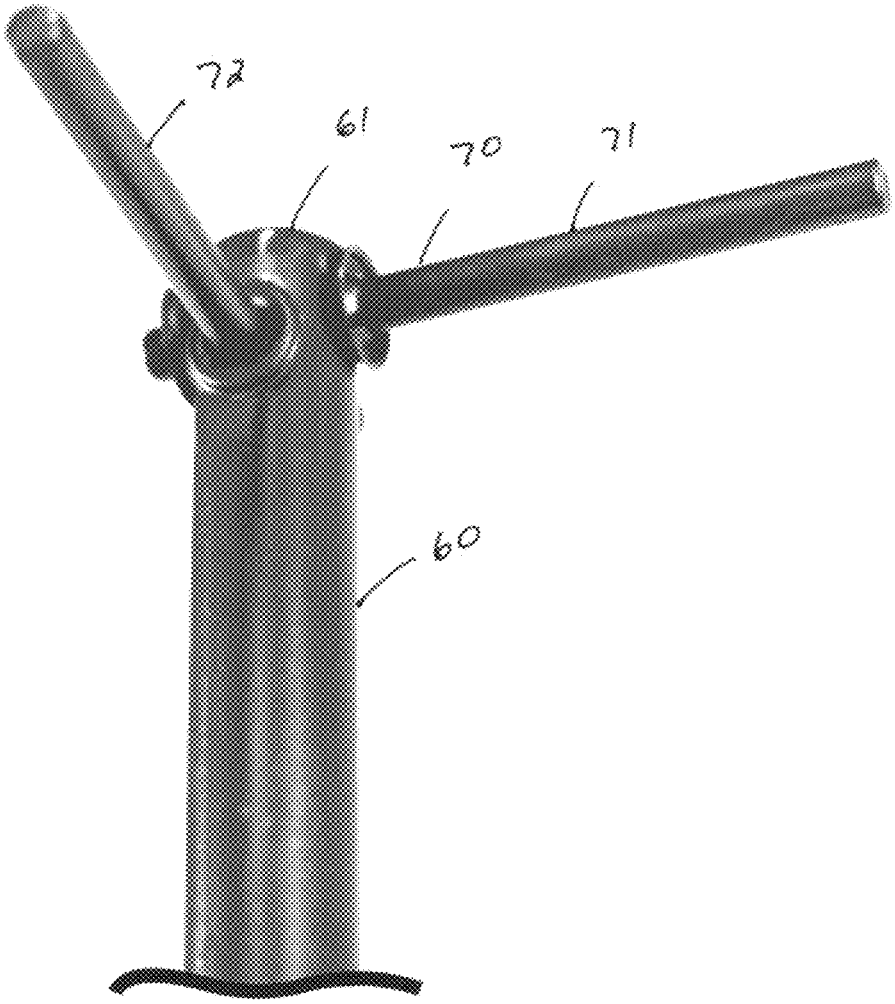
FIG. 6 is a close-up perspective view of an embodiment of an upper cradle.

The top cradle 70 is shown in a close-up view in FIG. 6. The top cradle has a first piece 71 and a second piece 72. Each of the pieces has a proximal end that is connected to the top 61 of the shaft in a fixed manner. Each of the pieces also has a distal end that is remote from the shaft. The pieces diverge from the shaft in a plane that is generally perpendicular to the longitudinal axis 63 of the shaft in a manner to form a V-shaped resting place or cradle for a supported object.

The base 90 forming the bottom cradle 91 is shown in close-up views in FIGS. 7-11. The base 90 has a first lower bracket 100 that is cooperatively positioned with a second lower bracket 140. The first lower bracket 100 is shown in isolation in FIG. 10. The second lower bracket is shown in isolation in FIG. 11.

The first lower bracket 100 has a first side section 110 having a leg pivot 111 that receives a fastener 112 (fastener can be fixed to the bracket). The fastener can be a threaded member having an elongated threaded shaft and a nut such as a wing nut that is engaged without tools to tighten and loosen the fastener. A leg positioner 113 is also provided. The leg positioner 113 has a receptacle 114 for a storage position of a leg 200, and three deployment holes 115, 116 and 117, respectively for aligning the leg 200 in a selected angular alignment with respect to the shaft. The deployment holes are aligned in an arc shaped pattern having a fixed radius to the leg pivot 111.

The first lower bracket 100 has a second side section 120 having a leg pivot 121 that receives a fastener 122. The fastener can be a threaded member having an elongated threaded shaft and a nut such as a wing nut that is engaged without tools to tighten and loosen the fastener. A leg positioner 123 is also provided. The leg positioner 123 has a receptacle 124 for a storage position of a leg 210, and three deployment holes 125, 126 and 127, respectively for aligning the leg 210 in a selected angular alignment with respect to the shaft. The deployment holes are aligned in an arc shaped pattern having a fixed radius to the leg pivot 121.

The first side section and second side section are preferably integrally formed from a single piece of material such as metal. However, it is understood that other materials, such as an aluminum casting, that are sufficiently strong could be used without departing from the broad aspects of the present invention. The first side section 110 and second side section 120 are each individually generally planar and are aligned in a generally right angle relative to each other.

The second lower bracket 140 has a first side section 150 having a leg pivot 151 that receives a fastener 152. The fastener can be a threaded member having an elongated threaded shaft and a nut such as a wing nut that is engaged without tools to tighten and loosen the fastener. A leg positioner 153 is also provided. The leg positioner 153 has a receptacle 154 for a storage position of a leg 220, and three deployment holes 155, 156 and 157, respectively for aligning the leg 220 in a selected angular alignment with respect to the shaft. The deployment holes are aligned in an arc shaped pattern having a fixed radius to the leg pivot 151.

The second lower bracket 140 has a second side section 160 having a leg pivot 161 that receives a fastener 162. The fastener can be a threaded member having an elongated threaded shaft and a nut such as a wing nut that is engaged without tools to tighten and loosen the fastener. A leg positioner 163 is also provided. The leg positioner 163 has a receptacle 164 for a storage position of a leg 230, and three deployment holes 165, 166 and 167, respectively for aligning the leg 230 in a selected angular alignment with respect to the shaft. The deployment holes are aligned in an arc shaped pattern having a fixed radius to the leg pivot 161.

The first side section and second side section are preferably integrally formed from a single piece of material such as metal. However, it is understood that other materials that are sufficiently strong could be used without departing from the broad aspects of the present invention. The first side section 150 and second side section 160 are each individually generally planar and are aligned in a generally right angle relative to each other.

The first lower bracket 100 and the second lower bracket 140 are connected to the bottom 62 of the shaft in a fixed manner. The brackets 100 and 140 cooperate to form the bottom cradle 91 that is radially aligned (with respect to the shaft 60) with the top cradle 70 and the securement device.

It is appreciated that in an alternative embodiment, that the bottom cradle could be made of a wood block being made of one or more pieces, an aluminum casting, or a reinforced plastic molding. Gussets or other stiffening elements can also be used to provide strength to the present invention.

Four legs 200, 210, 220 and 230 are illustrated in the preferred embodiment, and are seen in isolation in FIG. 31. However, it is appreciated that more or fewer could be used without departing from the broad aspects of the present invention. It is appreciated that at least three legs are required in order to form a self-supporting free-standing base.

Leg 200 has a first end 201 (proximal) and a second end 204 (distal). A pivot hole 202 is adjacent the first end 201. A stud 203 is provided near or adjacent the hole 202 but further from end 201 than hole 202. Each of the hole 202 and stud 203 are preferably generally centrally aligned on the leg. Fastener 112 is used to pivotally connect the leg 200 to the first side section 110 of the first lower bracket 100 in a pivotal relationship. The pivot is offset from the shaft longitudinal axis 63. The stud 203 can be selectably positioned in the receptacle 114 for storage or in one of the deployment holes 115, 116 or 117 for deployment in a narrow, intermediate or wide deployment position, respectively.

Leg 210 has a first end 211 (proximal) and a second end 214 (distal). A pivot hole 212 is adjacent the first end 211. A stud 213 is provided near or adjacent the hole 212 but further from end 211 than hole 212. Each of the hole 212 and stud 213 are preferably generally centrally aligned on the leg. Fastener 122 is used to pivotally connect the leg 210 to the second side section 120 of the first lower bracket 100 in a pivotal relationship. The pivot is offset from the shaft longitudinal axis 63. The stud 213 can be selectably positioned in the receptacle 124 for storage or in one of the deployment holes 125, 126 or 127 for deployment in a narrow, intermediate or wide deployment position, respectively.

Leg 220 has a first end 221 (proximal) and a second end 224 (distal). A pivot hole 222 is adjacent the first end 221. A stud 223 is provided near or adjacent the hole 222 but further from end 221 than hole 222. Each of the hole 222 and stud 223 are preferably generally centrally aligned on the leg. Fastener 152 is used to pivotally connect the leg 220 to the first side section 150 of the second lower bracket 140 in a pivotal relationship. The pivot is offset from the shaft longitudinal axis 63. The stud 223 can be selectably positioned in the receptacle 154 for storage or in one of the deployment holes 155, 156 or 157 for deployment in a narrow, intermediate or wide deployment position, respectively.

Leg 230 has a first end 231 (proximal) and a second end 234 (distal). A pivot hole 232 is adjacent the first end 231. A stud 233 is provided near or adjacent the hole 232 but further from end 231 than hole 232. Each of the hole 232 and stud 233 are preferably generally centrally aligned on the leg. Fastener 162 is used to pivotally connect the leg 230 to the second side section 160 of the second lower bracket 140 in a pivotal relationship. The pivot is offset from the shaft longitudinal axis 63. The stud 233 can be selectably positioned in the receptacle 164 for storage or in one of the deployment holes 165, 166 or 167 for deployment in a narrow, intermediate or wide deployment position, respectively.

Figure 4:
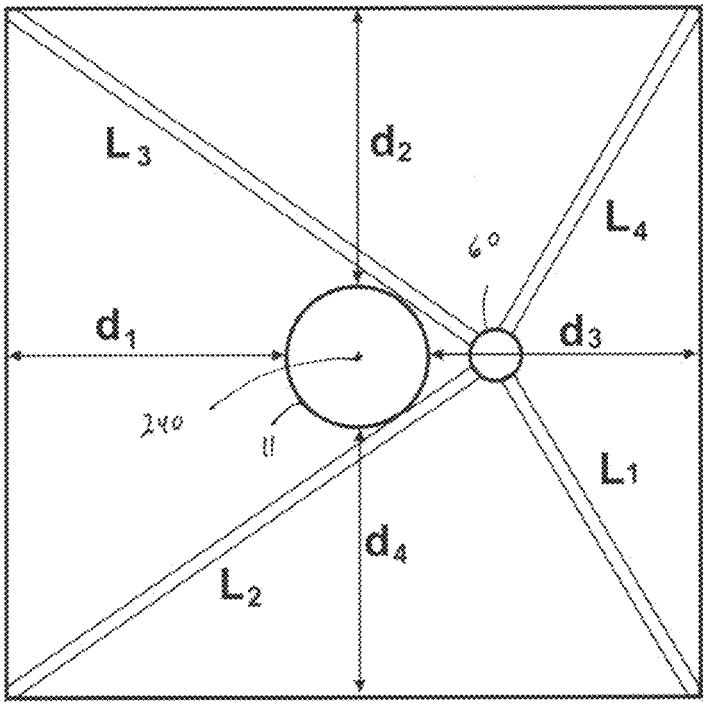
FIG. 4 is a schematic plan view showing the geometric relationship between the stand and an object held by the stand.

Turing now back to FIGS. 3 and 4, it is seen that the distal ends of the legs define a midpoint of a deployment shape (a leg center) wherein the normal distances of lines drawn from the center of the object being held to the perpendicular intersection with lines drawn between adjacent legs are generally equal in length. These distances are noted in FIG. 4 as d1, d2, d3 and d4. The legs extend generally radially from the shaft. That is, the legs are each pivotally connected to the bottom cradle 91 at points that are a selected distance from the shaft center axis 63 of shaft 60. Further, the legs define an offset center point 240. The offset center point is preferably offset from the shaft axis 63 by a given amount that is approximately equal to the radius of an object that is to be held by the holder 50. The offset distance is radially oriented towards the center of the cradles 70 and 91. The creation of the offset center point is a result of having two different lengths for legs. In this regard, as noted in FIG. 4, L4=L1, and L2=L3, wherein L1 and L4 and shorter than L2 and L3.

It is appreciated that while in FIG. 4, the shape defined by the distal ends of the legs is generally square, that the shape could be trapezoidal or have another shape without departing from the broad aspects of the present invention.

It is appreciated that while the studs are shown to operate between the legs and the lower cradle (or base), and that the studs are fixed to the legs, that in an alternative embodiment, that one or more studs could be affixed to the base and that the legs could have a one or more holes to receive the stud(s).

It is further appreciated that while three deployment holes are shown, that in an alternative embodiment, more or fewer holes could be utilized. Further, it is appreciated that an arc shaped slot could be used instead of discrete holes, thereby allowing for infinite amounts of adjustment. Still further, it is appreciated that other alternative angle adjustment mechanisms such as a bracket having rotatably adjustable mating faces could be used without departing from the broad aspects of the present invention.

Further, it is appreciated that a spring loaded fastening element could be used instead of a twistable fastener without departing from the broad aspects of the present invention.

Figure 17:
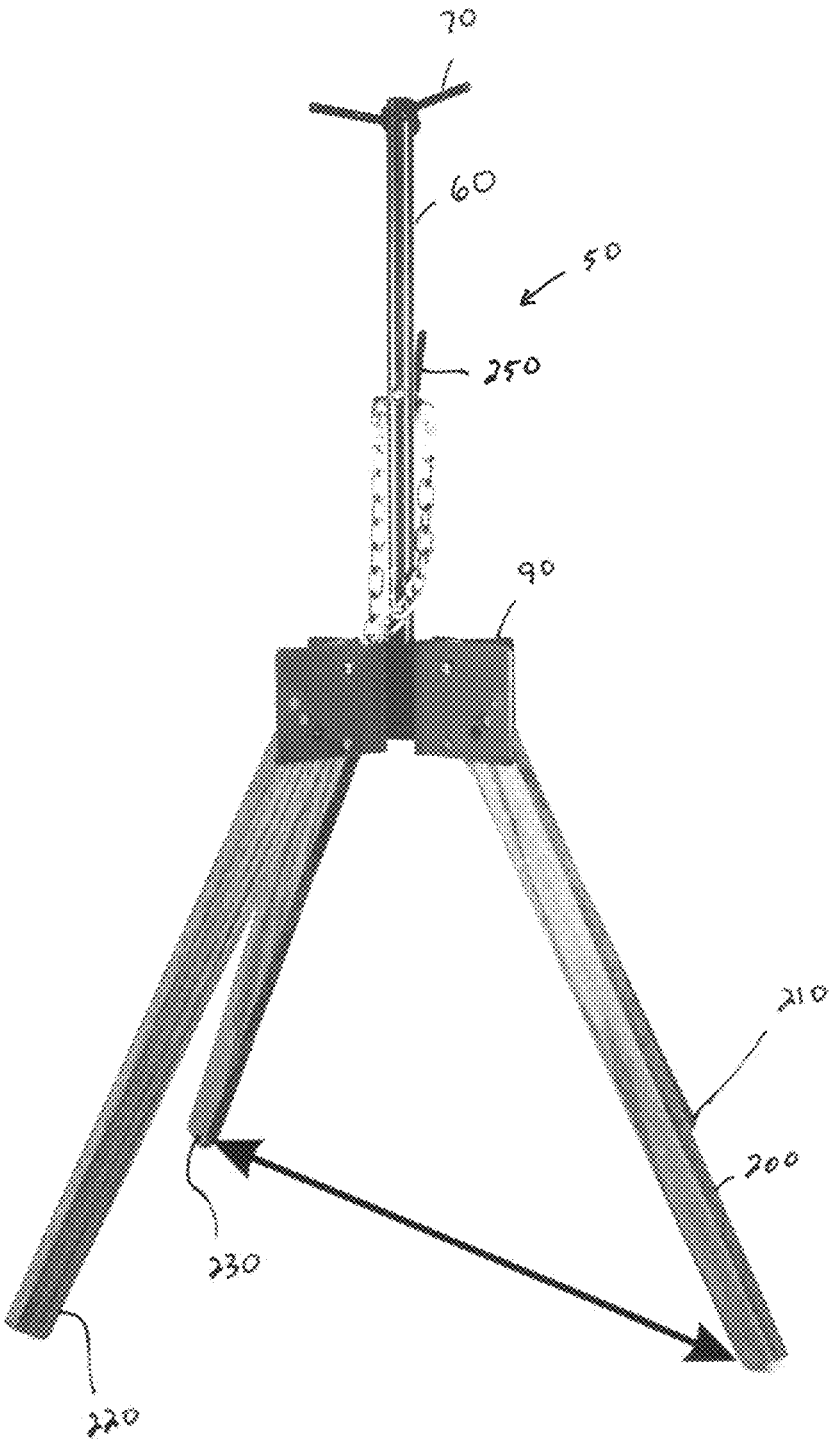
FIG. 17 is a perspective view showing the device having legs deployed in a narrow position.
Figure 18:
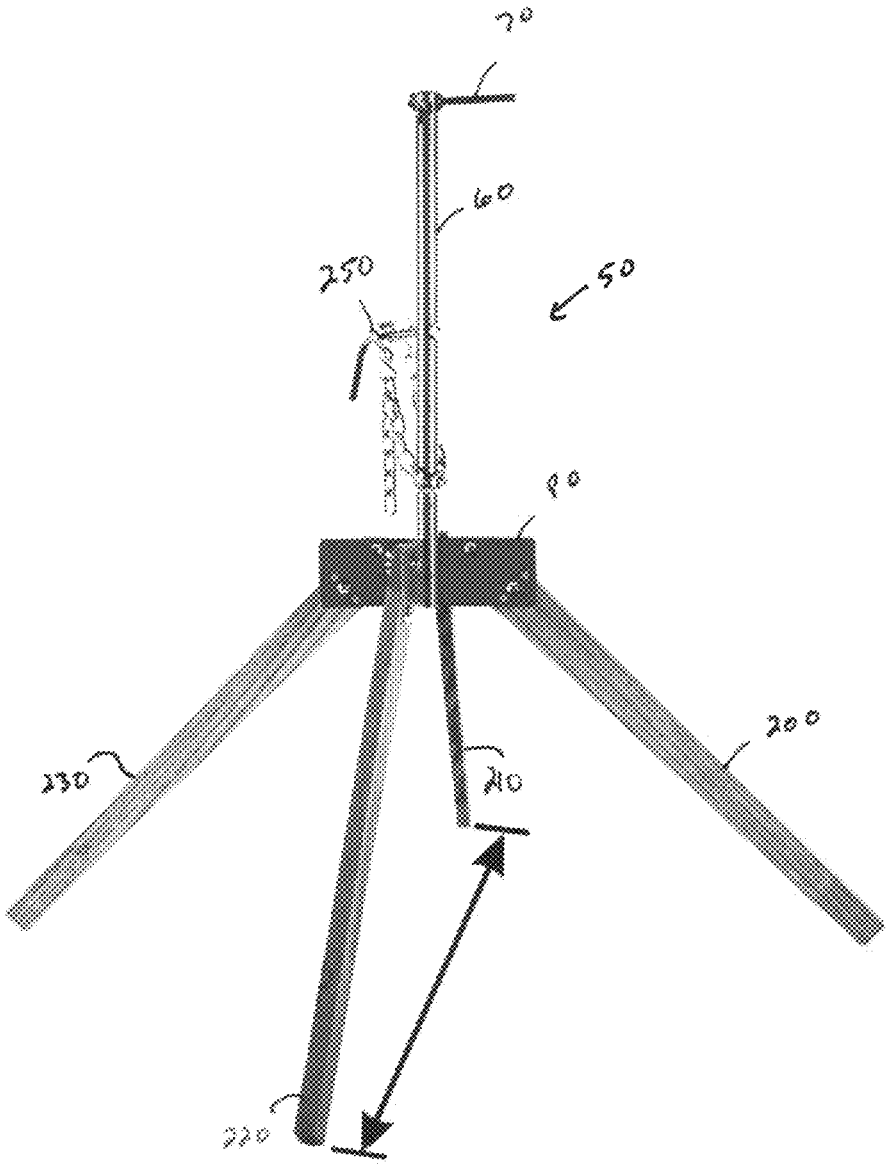
FIG. 18 is a perspective view showing the device having legs deployed in an intermediate position.
Figure 19:
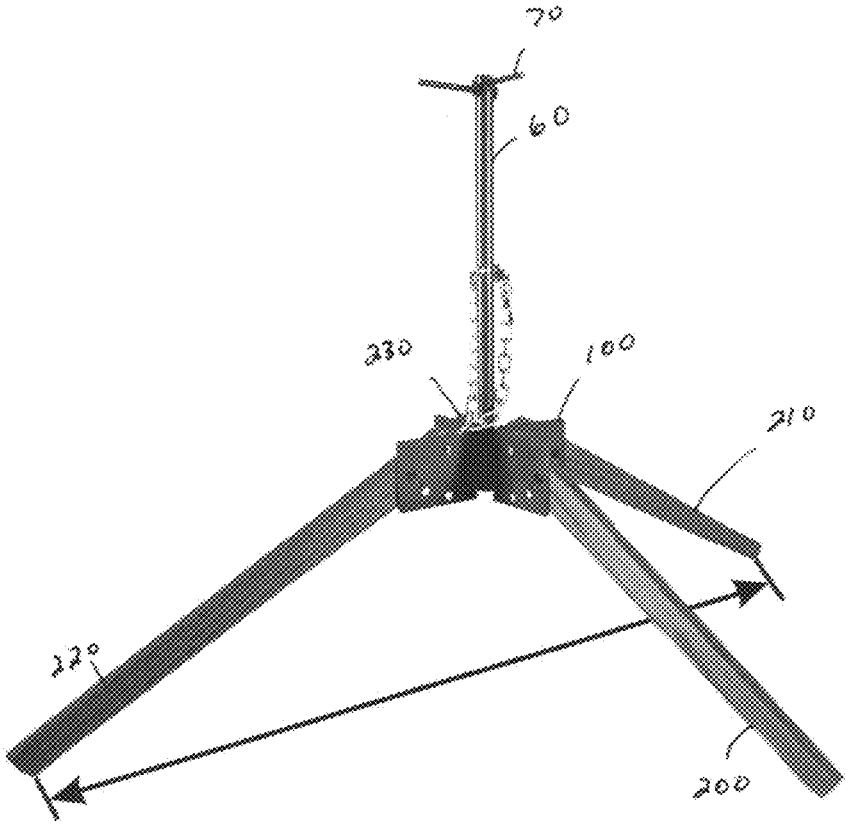
FIG. 19 is a perspective view showing the device having legs deployed in a wide position.

Looking now at FIGS. 17-19, it is seen that the legs 200, 210, 220 and 230 are illustrated in narrow, intermediate and wide deployment positions (defined by the footprint of the device). A wide deployment position (as compared to the narrow and intermediate positions) results in the respective distal ends of the legs defining larger normal distances. This increases stability of an object held by the stand. Further, the wider the deployment, the lower the cradles 70 and 91, and the securement device 250, are relative to the ground. This also increases stability. Increased stability is useful with taller (and often larger and wider) trees. As a result, increased stability can be achieved while the distal ends of the legs that can remain under the lower outer branch perimeter of the lower tree branches. It is appreciated that the legs do not need to stay within the outer perimeter of the lower tree branches.

Figure 12:
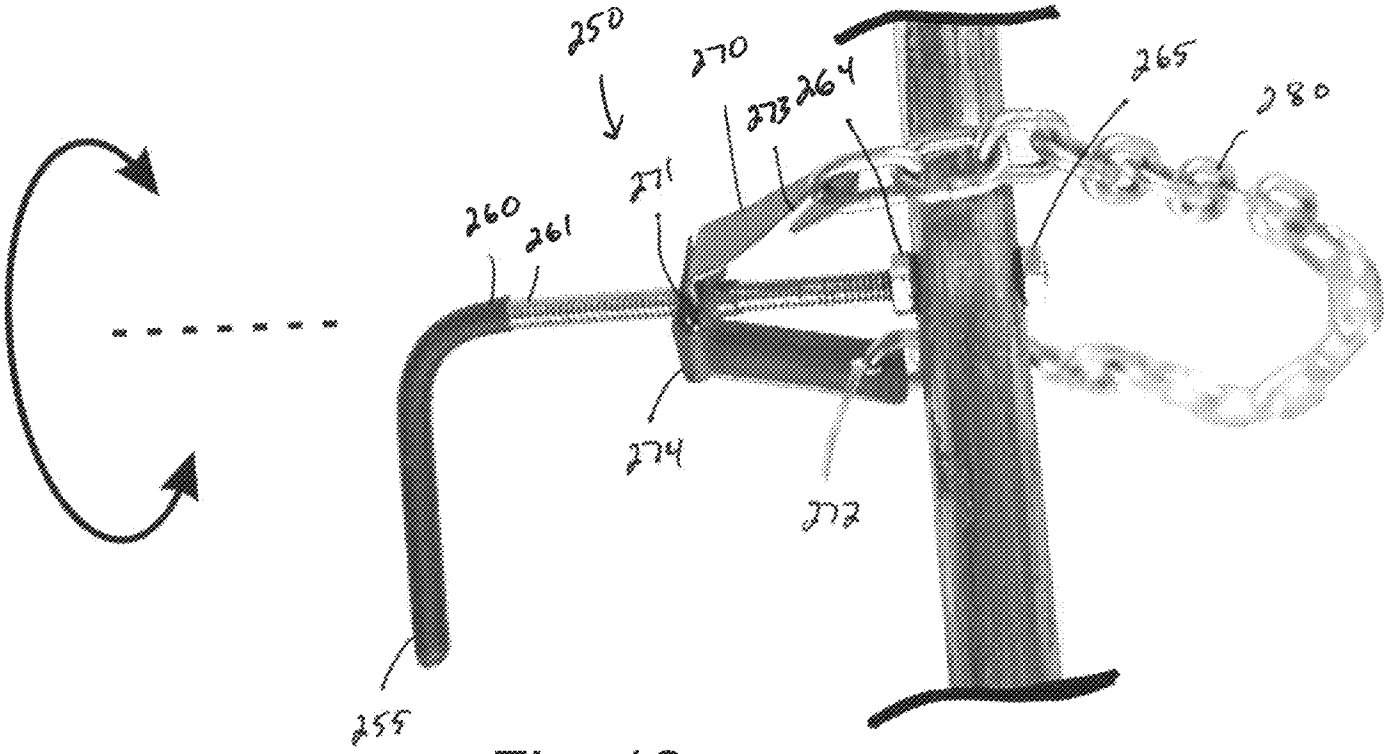
FIG. 12 is a close-up perspective view of a preferred embodiment of a securement device.
Figure 13:
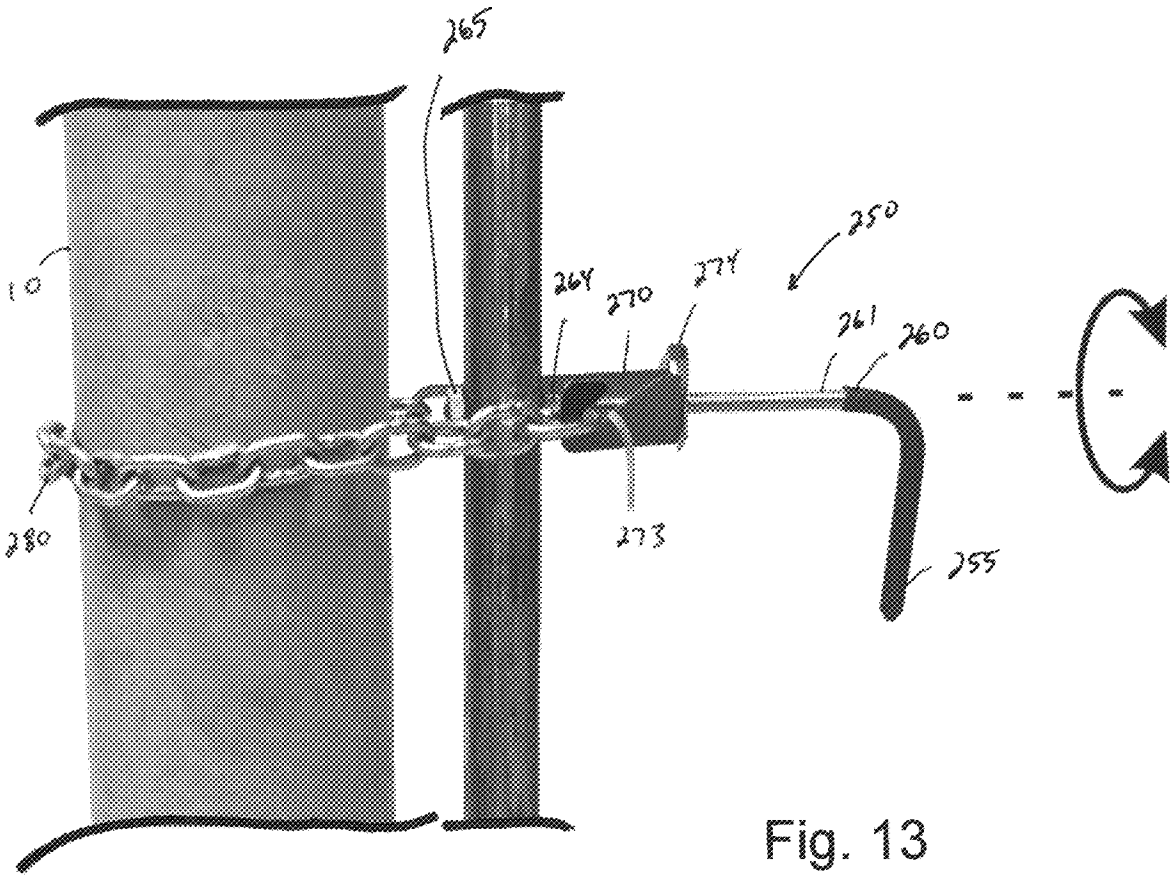
FIG. 13 is a close-up side view of the securement device secured to an object or item.
Figure 14A:
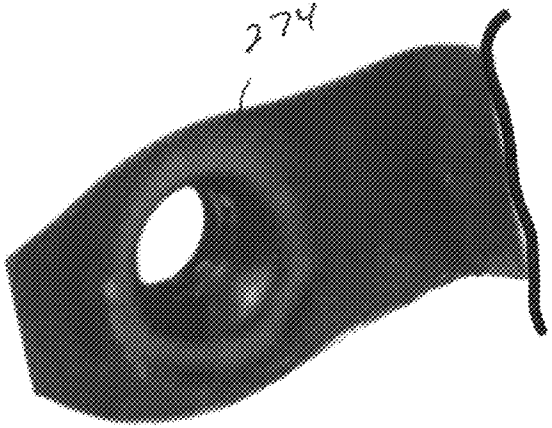
FIG. 14A is a close-up view showing an interior portion of the piece illustrated in FIG. 14.
Figure 14:
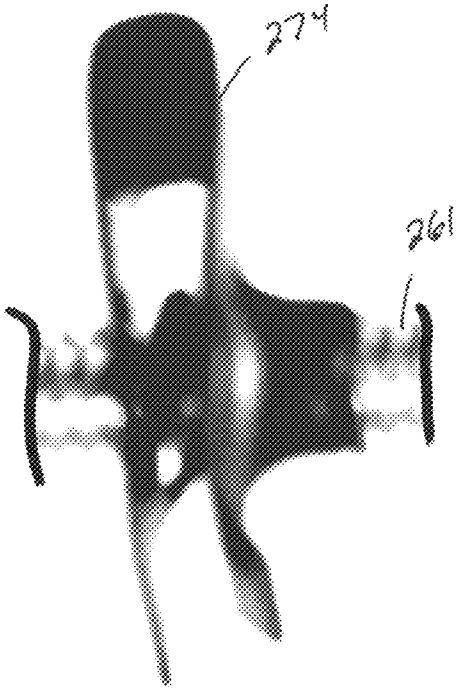
FIG. 14 is a close-up view showing a threaded positioning piece.

Turning now to FIGS. 12 and 13, it is seen that an embodiment of a securement device 250 is illustrated. The securement device 250 has a turning element 255 and a threaded element 260 that is threaded with threads 261. The turning element 255 is at a free end of the threaded element. The turning element 255 can be integrally formed with the threaded element 260. These two parts can be generally perpendicular to each other and allows for securement without the need for tools. A thrust bearing 264 and an end stop 265 are provided for attaching a second end of the threaded element 260 (connected end) to the shaft 60 is a rotatable and linearly stationary relationship. That is, the threaded element 260 can rotate relative to the shaft without linearly moving axially along a threaded element shaft axis. The threaded element extends generally perpendicularly away from the shaft in a direction opposite of the cradles 70 and 91. A chain carrier 270 is provided having a generally central hole 271 a first end with an end hole 272 and a second end with an end slot 273. A threaded positioning piece (FIG. 12-14A) is connected to the chain carrier 270. The positioning piece 274 is threadably connected to the threaded element, whereby turning of the threaded element relative to the positioning element causes the positioning element to advance away from or retreat towards the shaft in a linear axial manner along the axis of the positioning element.

One end of the securement device can be connected to the end hole 272. Then, the securing device 280 is wrapped around the object being held and engaged to slot 273 so that it is taught and that the device engages the cradles 70 and 91 (extra or unnecessary links can be dropped or hang freely from the securement device). Then, the turning element 255 is used to rotate the threaded element 160 whereby the positioning piece is moved away from the shaft in a direction opposite of the object being held. This increases tension in the securing element and allows the object to be securely held by the stand 50.

Figure 24:
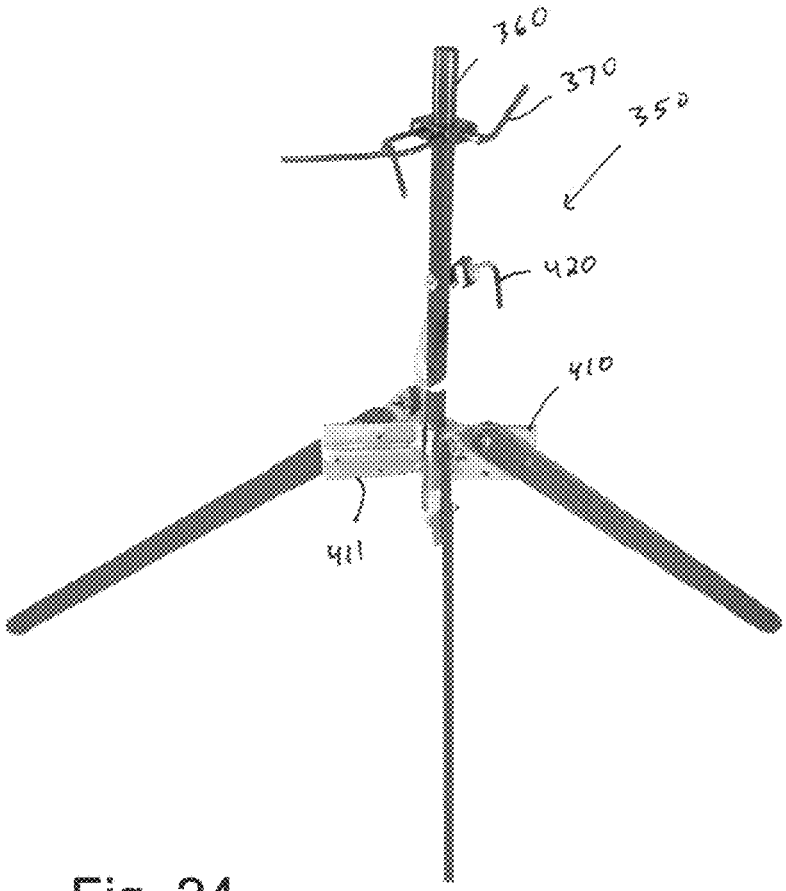
FIG. 24 is a perspective view of a stand incorporating the upper cradle shown in FIG. 21.
Figure 25:
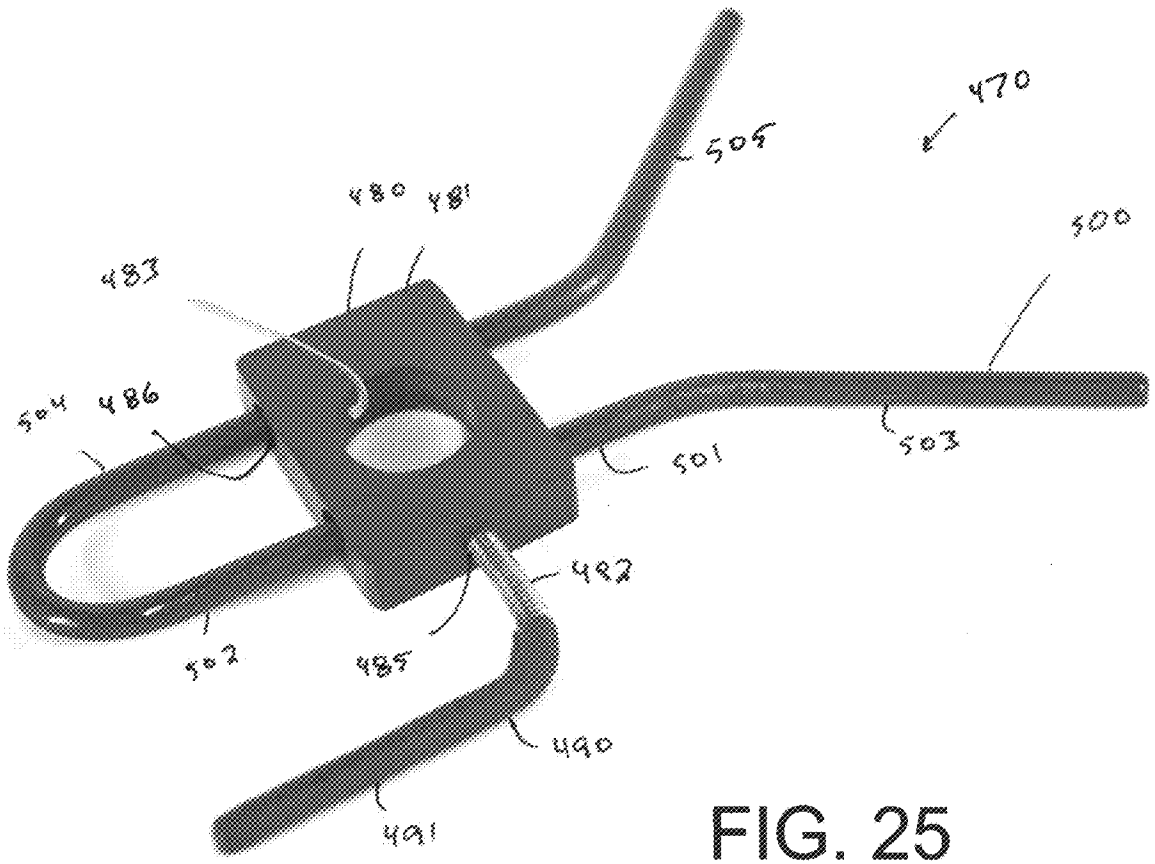
FIG. 25 is a perspective view of an alternative embodiment of a top cradle of the present invention.
Figure 26:
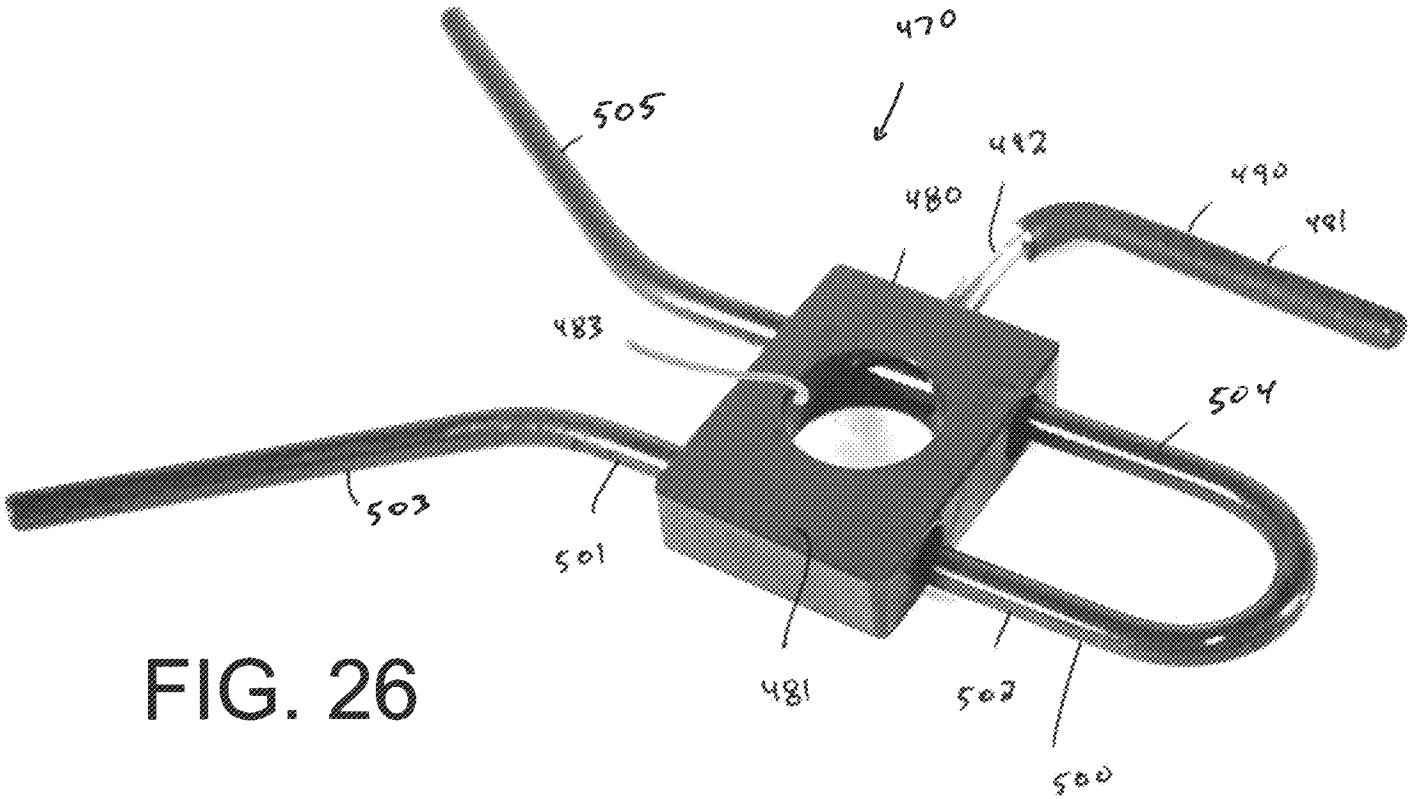
FIG. 26 is a reverse perspective view of the alternative top cradle illustrated in FIG. 25.
Figure 27:
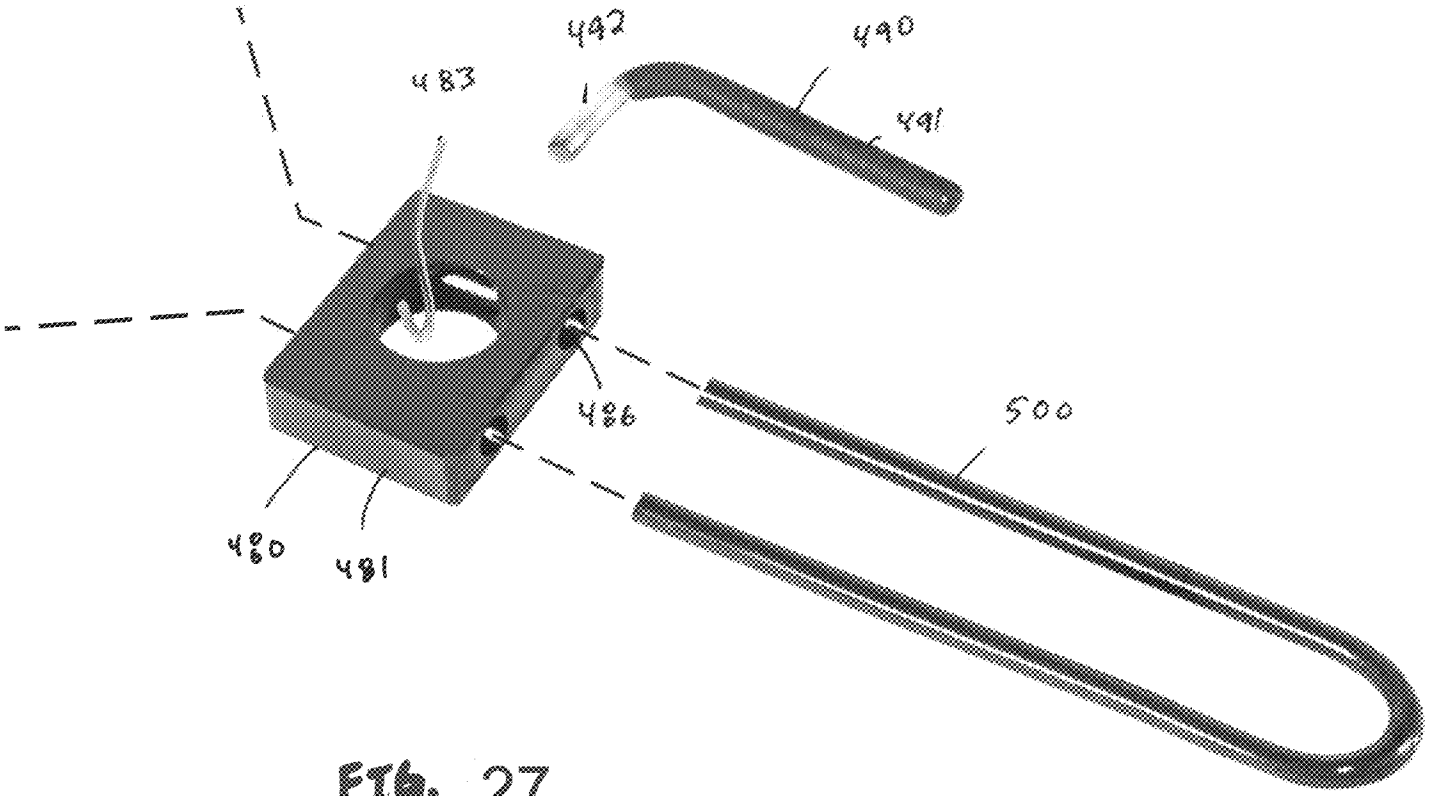
FIG. 27 is a exploded view of the alternative top cradle illustrated in FIG. 25.
Figure 28:
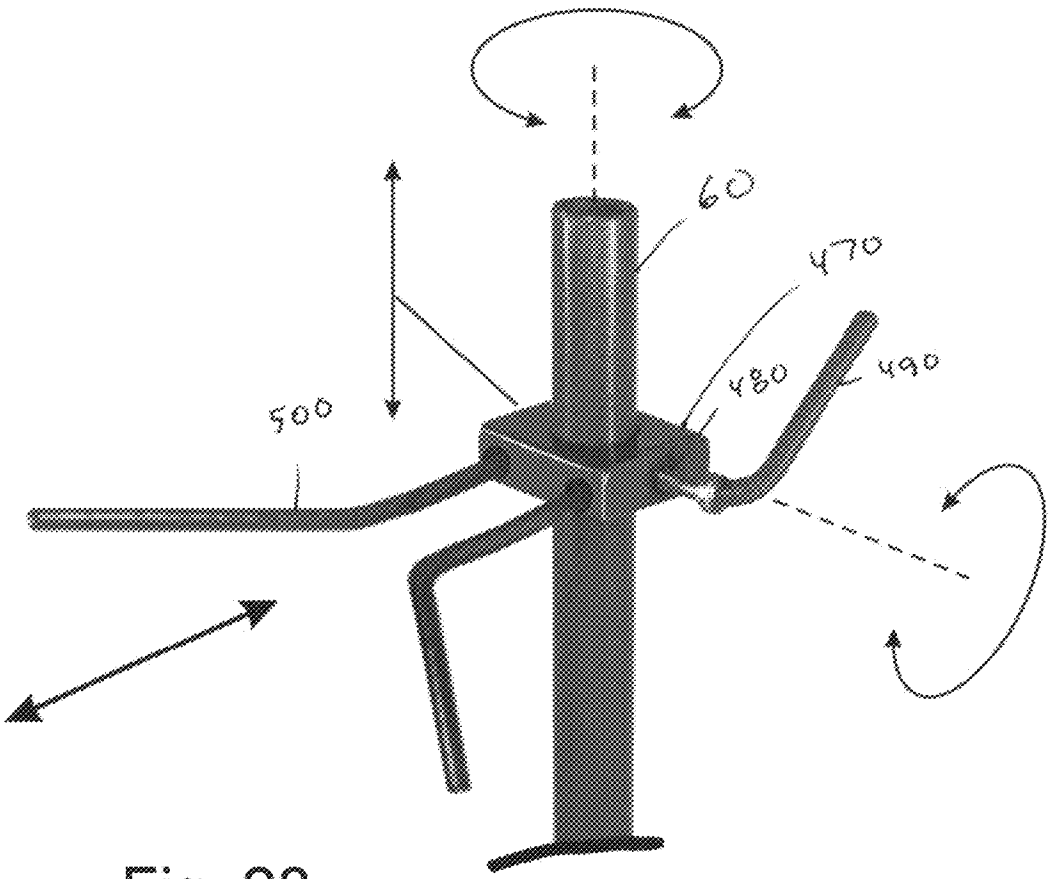
FIG. 28 shows the top cradle of FIG. 25 connected to a shaft and illustrating three independent adjustments that can be made between the cradle and the shaft.
Figure 29:
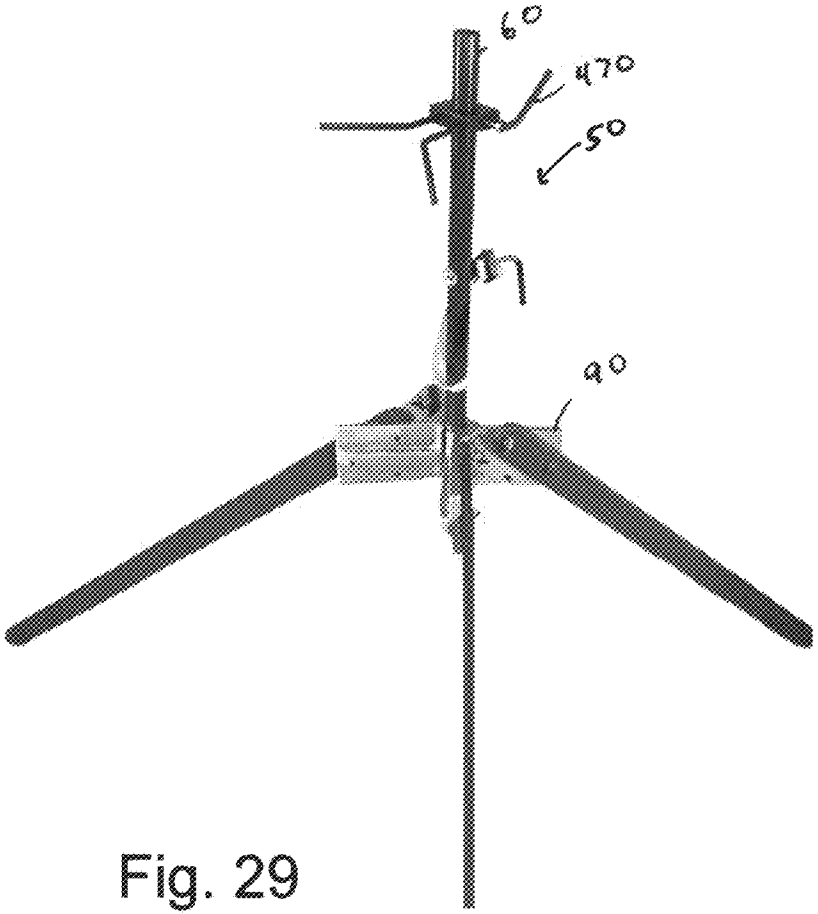
FIG. 29 is a perspective view of a stand incorporating an alternative embodiment of a top cradle as illustrated in FIG. 25.
Figure 30:
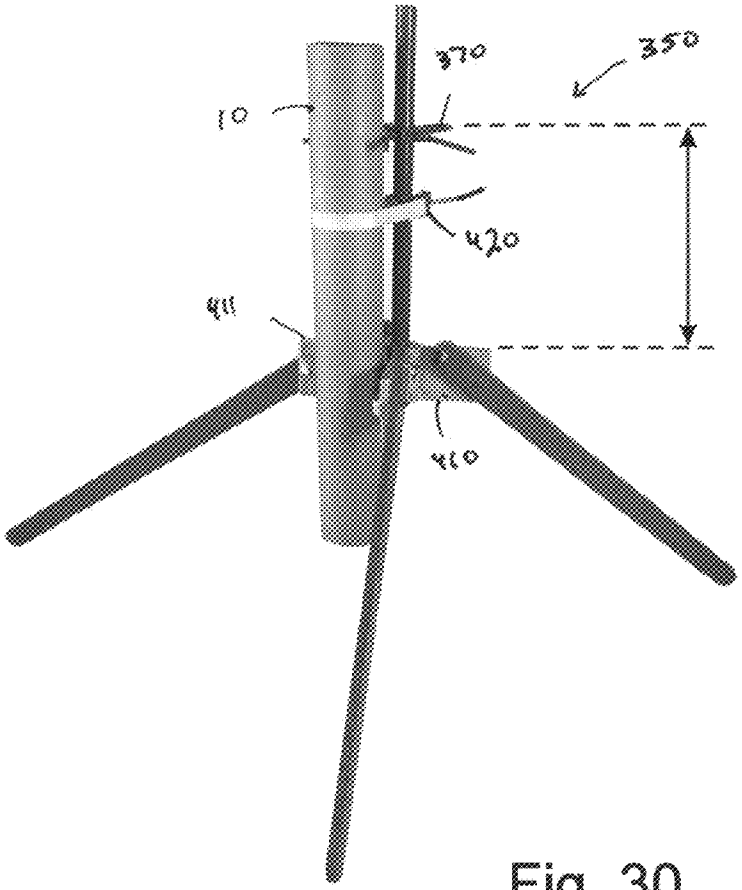
FIG. 30 is a perspective view showing a variable distance between and upper cradle and a lower cradle.

A securing element 280 is provided and can be a chain. Yet, it is appreciated that other elements such as straps 290 or other flexible yet axially strong components can be used without departing from the broad aspects of the present invention. A strap is shown in FIGS. 3, 24 and 30. The strap 290 has two ends that are fastened to a carrier with buckles or other securing devices.

Figure 15:
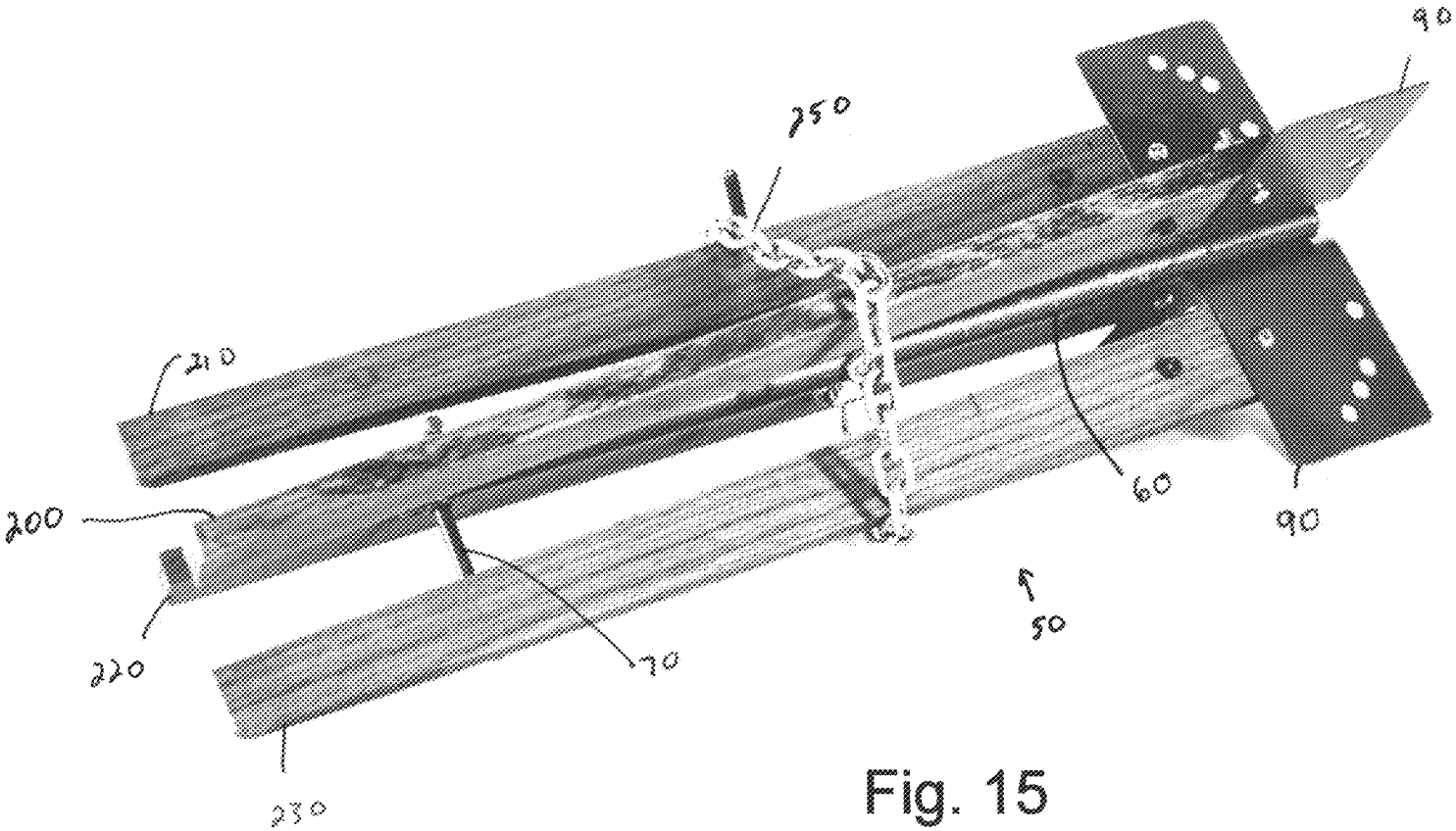
FIG. 15 is a perspective view showing the device in a first storage position.
Figure 16:
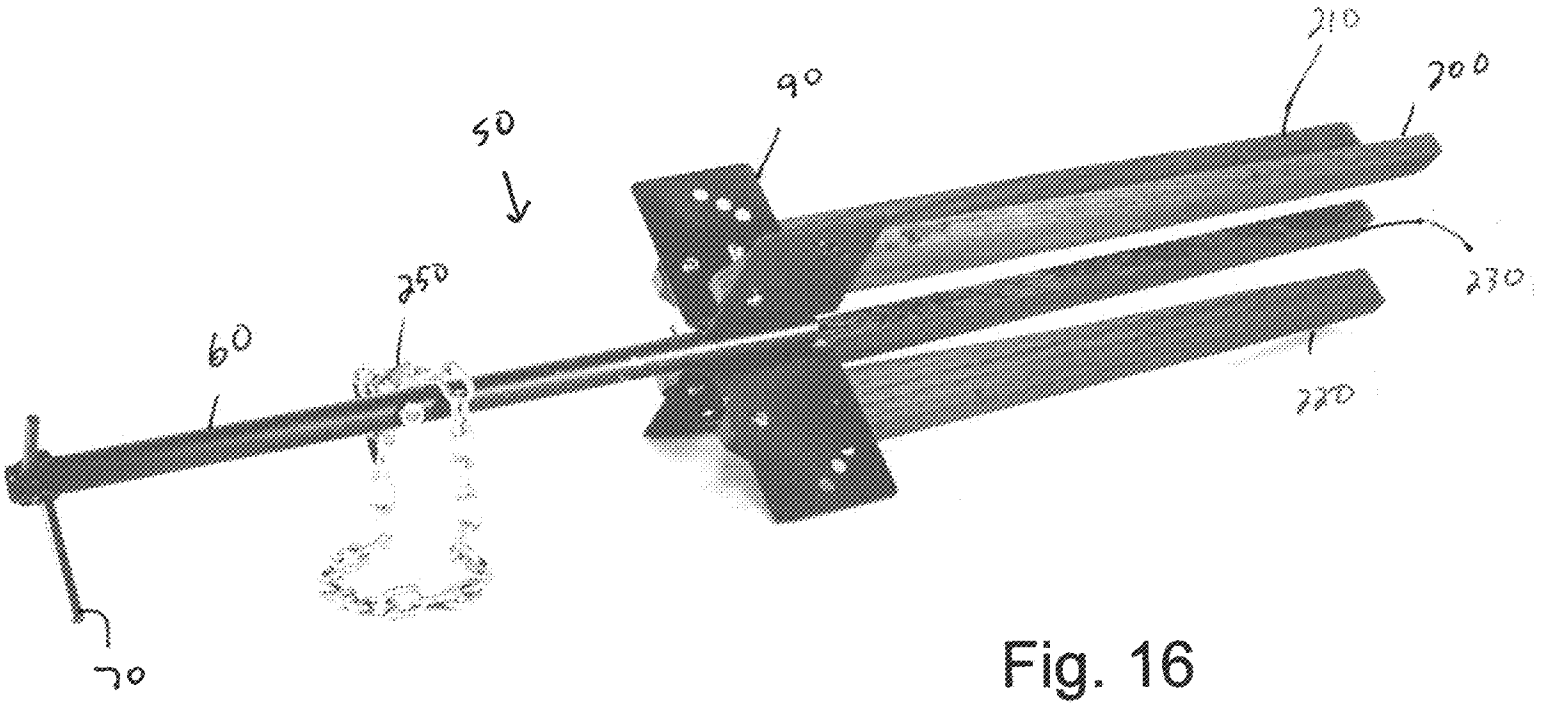
FIG. 16 is a perspective view showing the device in a second storage position.

Turning now to FIGS. 15 and 16, it is seen that two storage positions are provided. In a first position (FIG. 15), the legs are freely pivoted towards the top cradle 70 until they are approximately parallel with the shaft axis 30. Then, the tensioning element can be used to secure the legs in place or the fastening elements (nut) can be tightened to frictionally hold the respective legs in place. This position is useful for shipping and compact storage. In a second position (FIG. 16), the legs are pivoted until the studs engage the respective receptacles, wherein the legs are securely held in a position where they extend away from the lower cradle 91 in orientations that are generally parallel to the shaft axis 30. This position is useful for transport when connected to a tree or other object. In an alternative embodiment, the legs can be held in position by friction if a storage hole is not provided.

Figure 20:
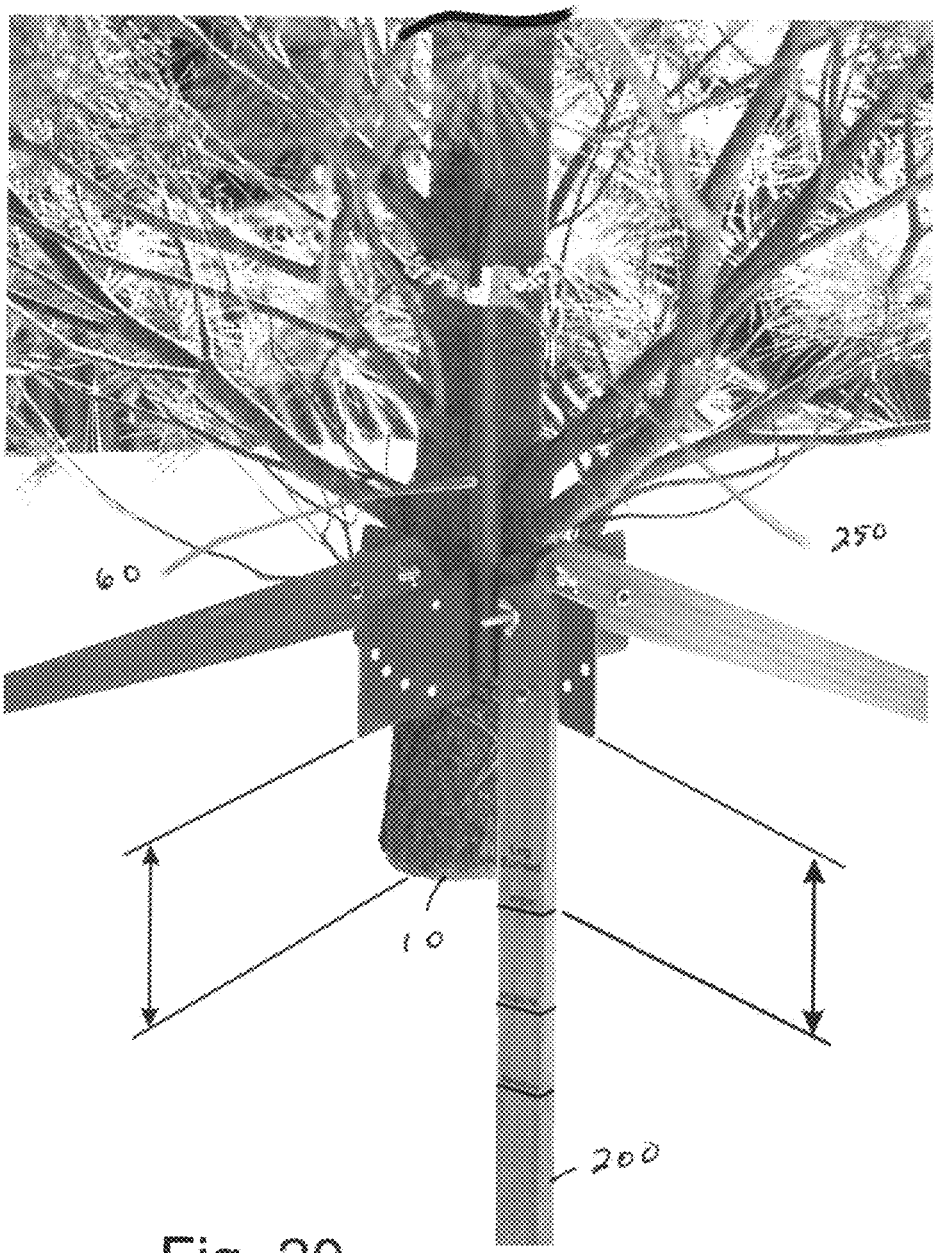
FIG. 20 is a perspective view of an alternative embodiment of the present invention showing markings on legs illustrating where to attach the stand to an object.
Figure 21:
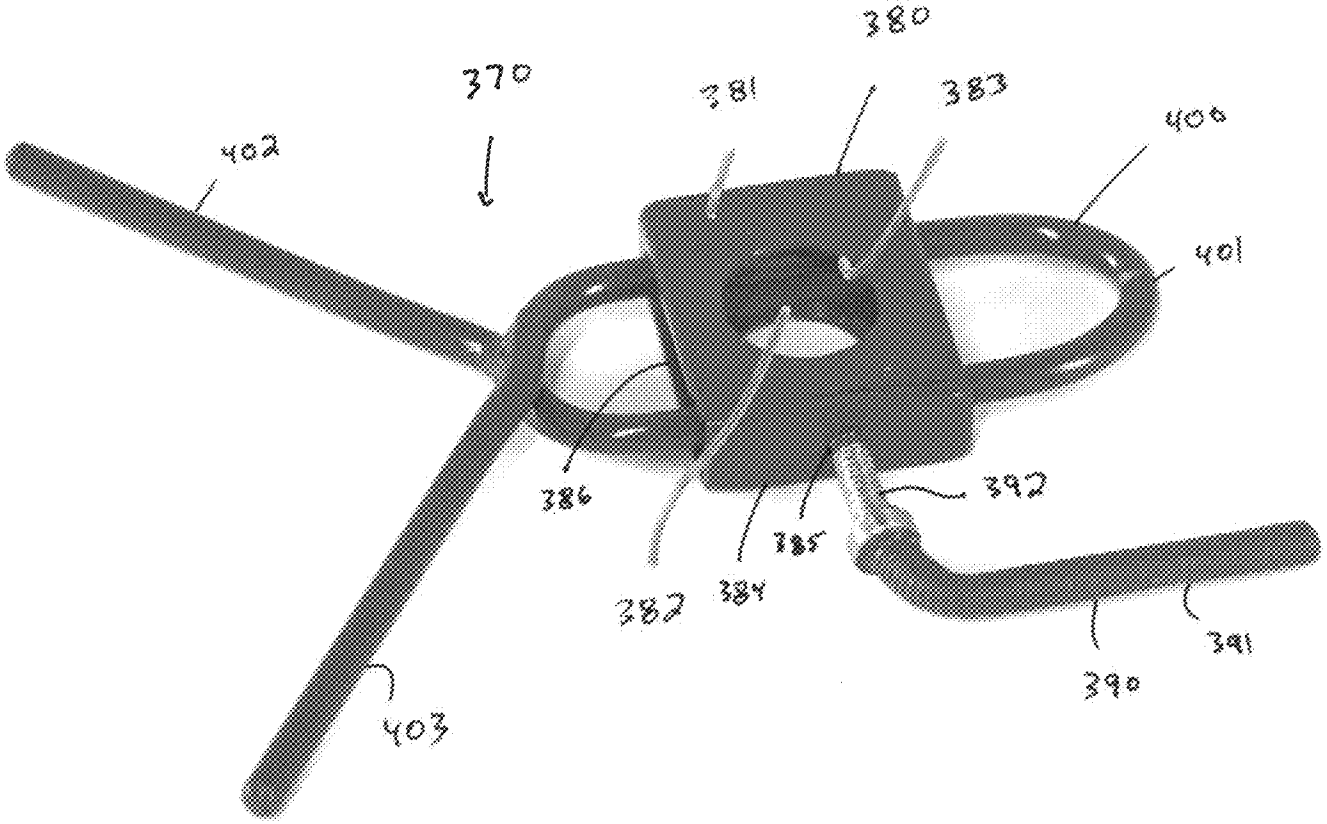
FIG. 21 is an isolation view of an alternative embodiment of a top cradle of the present invention.
Figure 22:
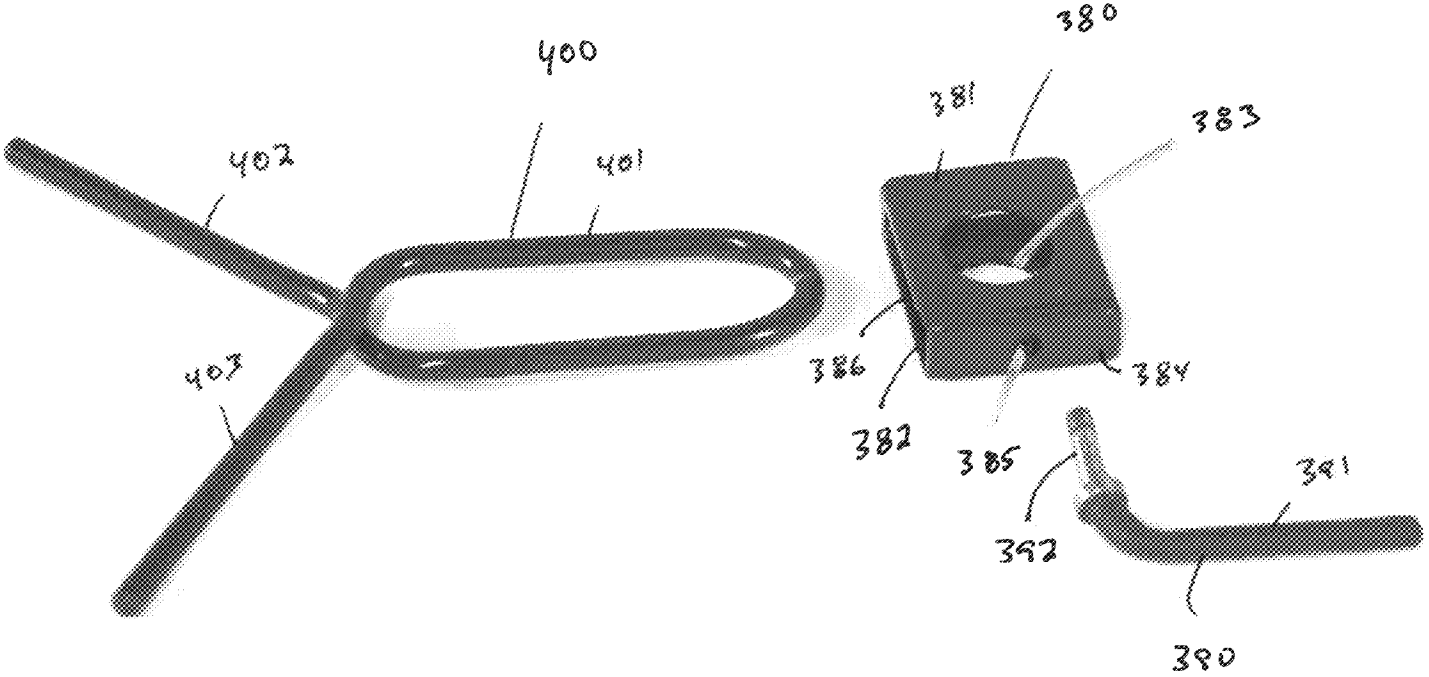
FIG. 22 is an exploded view of the embodiment illustrated in FIG. 21.
Figure 23:
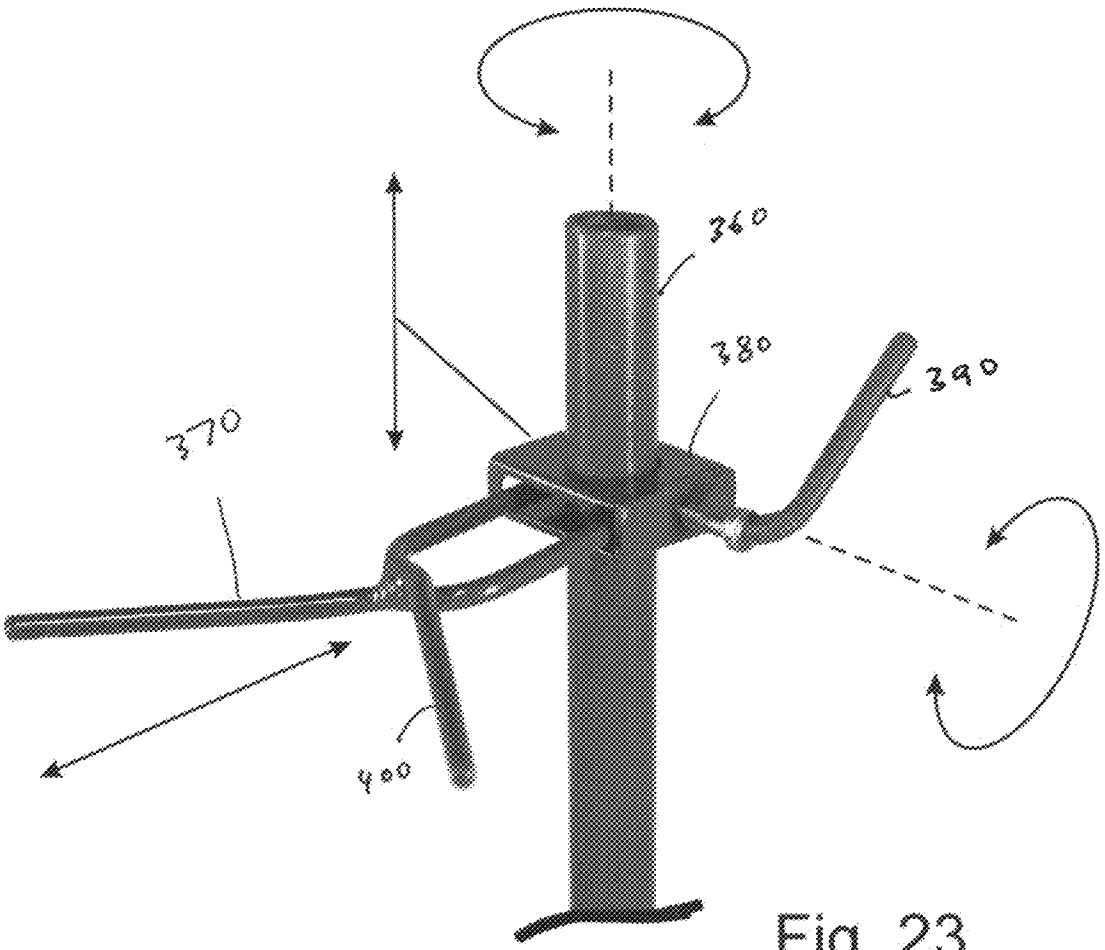
FIG. 23 is a close-up perspective view of an alternative embodiment of the upper cradle of FIG. 21 and illustrating three independent adjustments that can be made between the cradle and the shaft.

Turning now to FIG. 20, it is seen that marks can be placed on the legs to alert people where to mount the cradles relative to the tree so that the bottom of the tree is a selected distance (example, 1 inch) off of the ground or floor when the legs are positioned to their selected deployment position and can allow for maximum depth of water or other liquid for maximum immersion in the optional reservoir.

In an alternative embodiment, the upper cradle can be vertically adjustable relative to the shaft. In this regard, the separation of the cradles can be adjusted. Also, the upper cradle can be adjusted to avoid interference with a branch.

Figure 7:
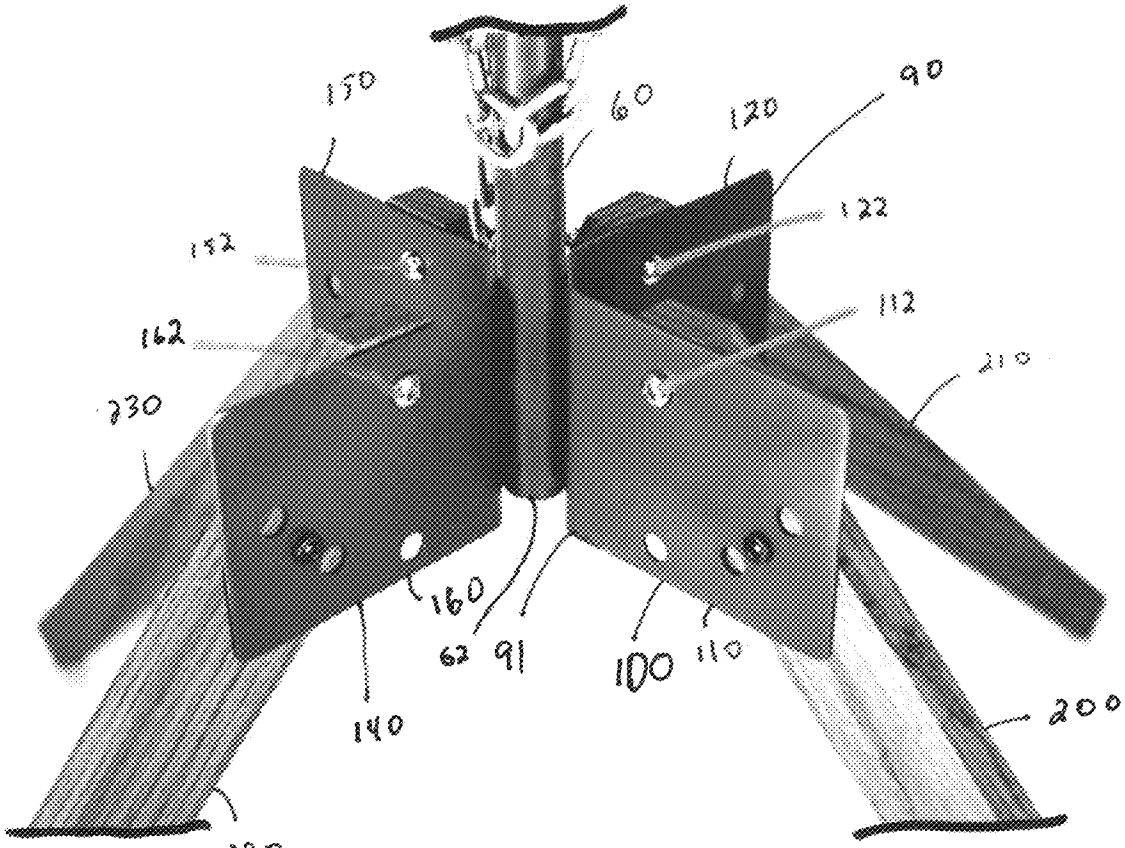
FIG. 7 is a close-up perspective view of a preferred embodiment of a bottom cradle.
Figure 7A:
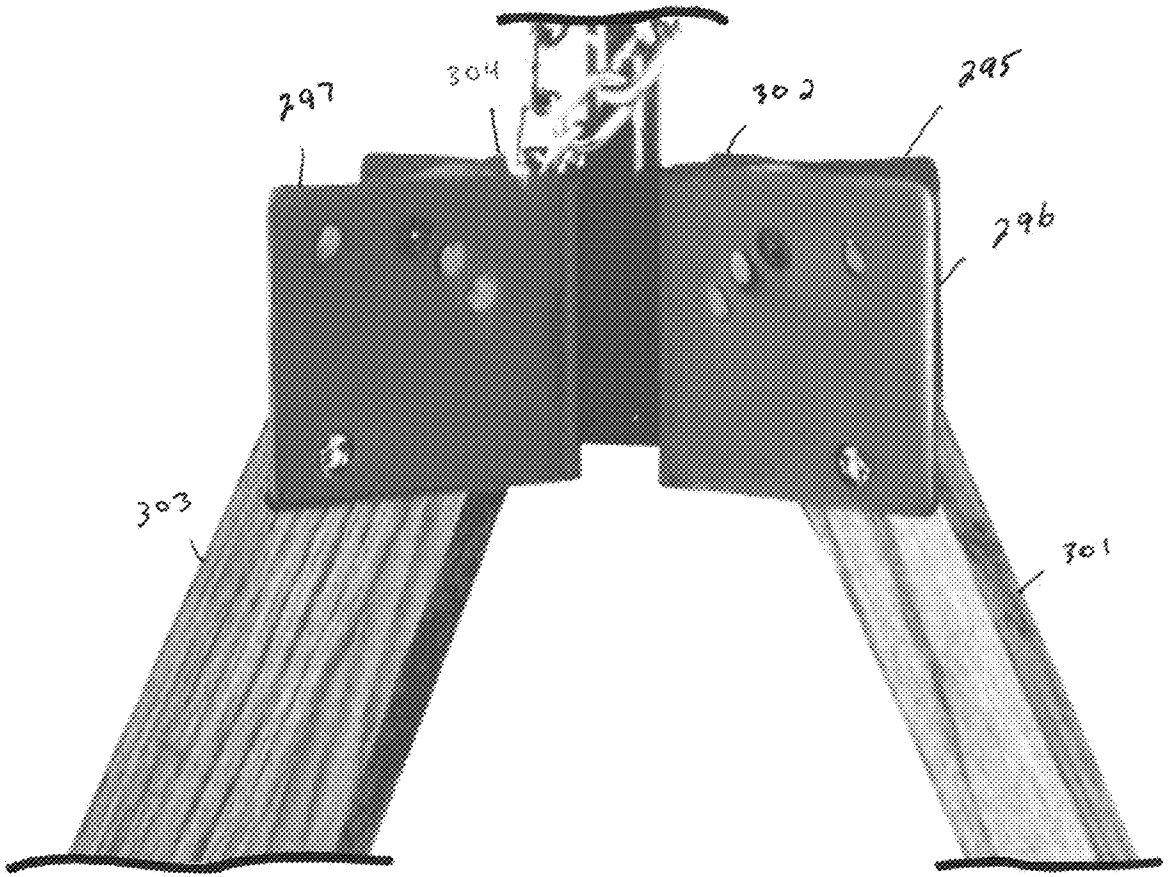
FIG. 7A is similar to FIG. 7, but shows an alternative embodiment of the lower brackets.
Figure 8:
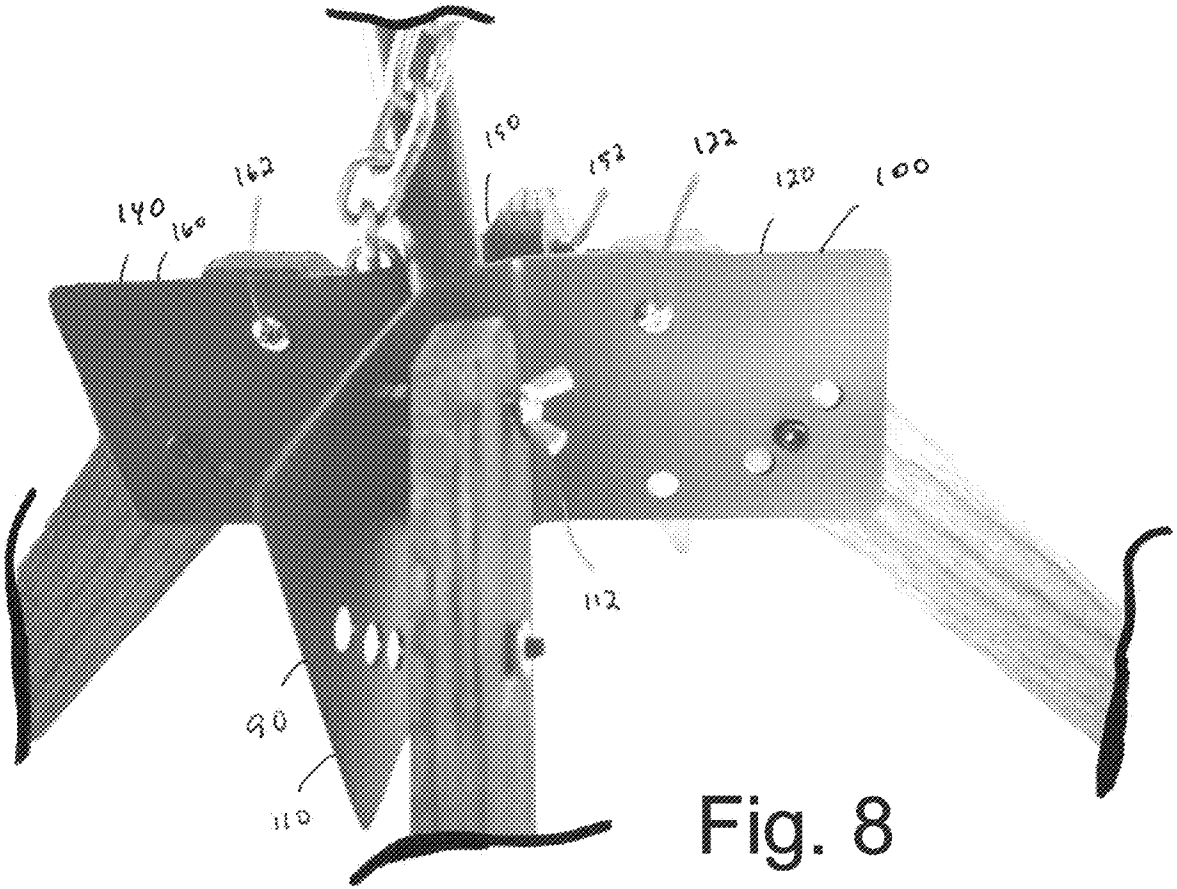
FIG. 8 is an alternative view of the bottom cradle shown in FIG. 7 showing a fastener in a loosened position.
Figure 9:
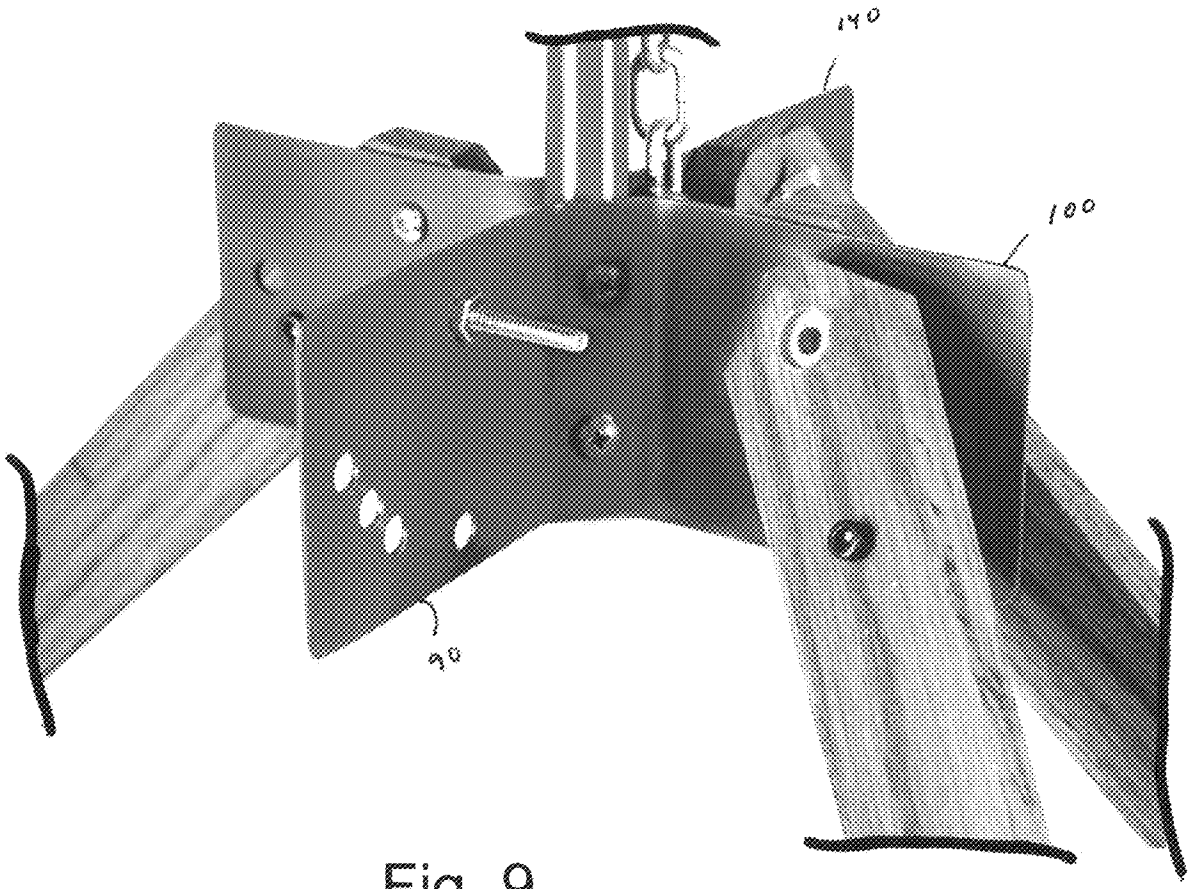
FIG. 9 is an additional alternative view of the bottom cradle shown in FIG. 7 with one leg unassembled.
Figure 10:
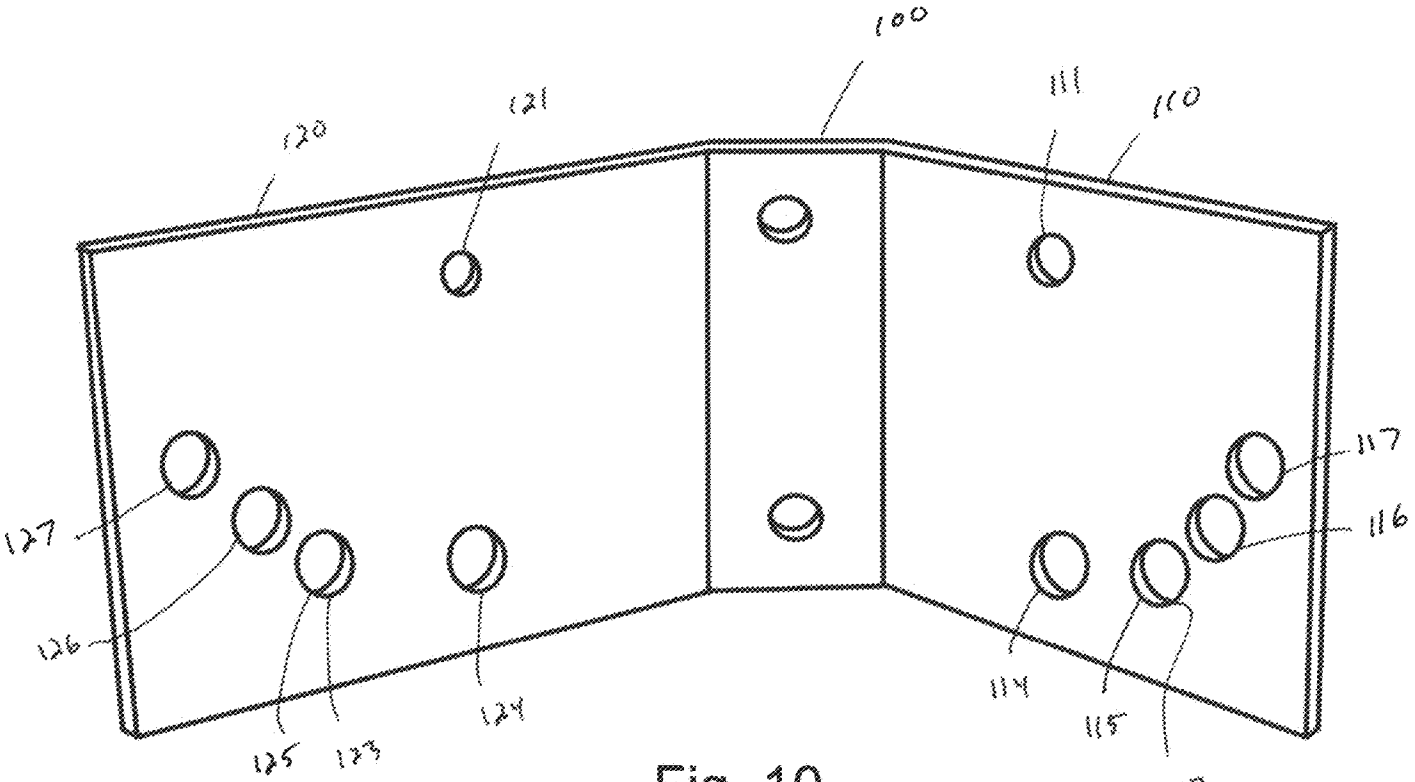
FIG. 10 is an isolation perspective view of a preferred first lower bracket.
Figure 11:
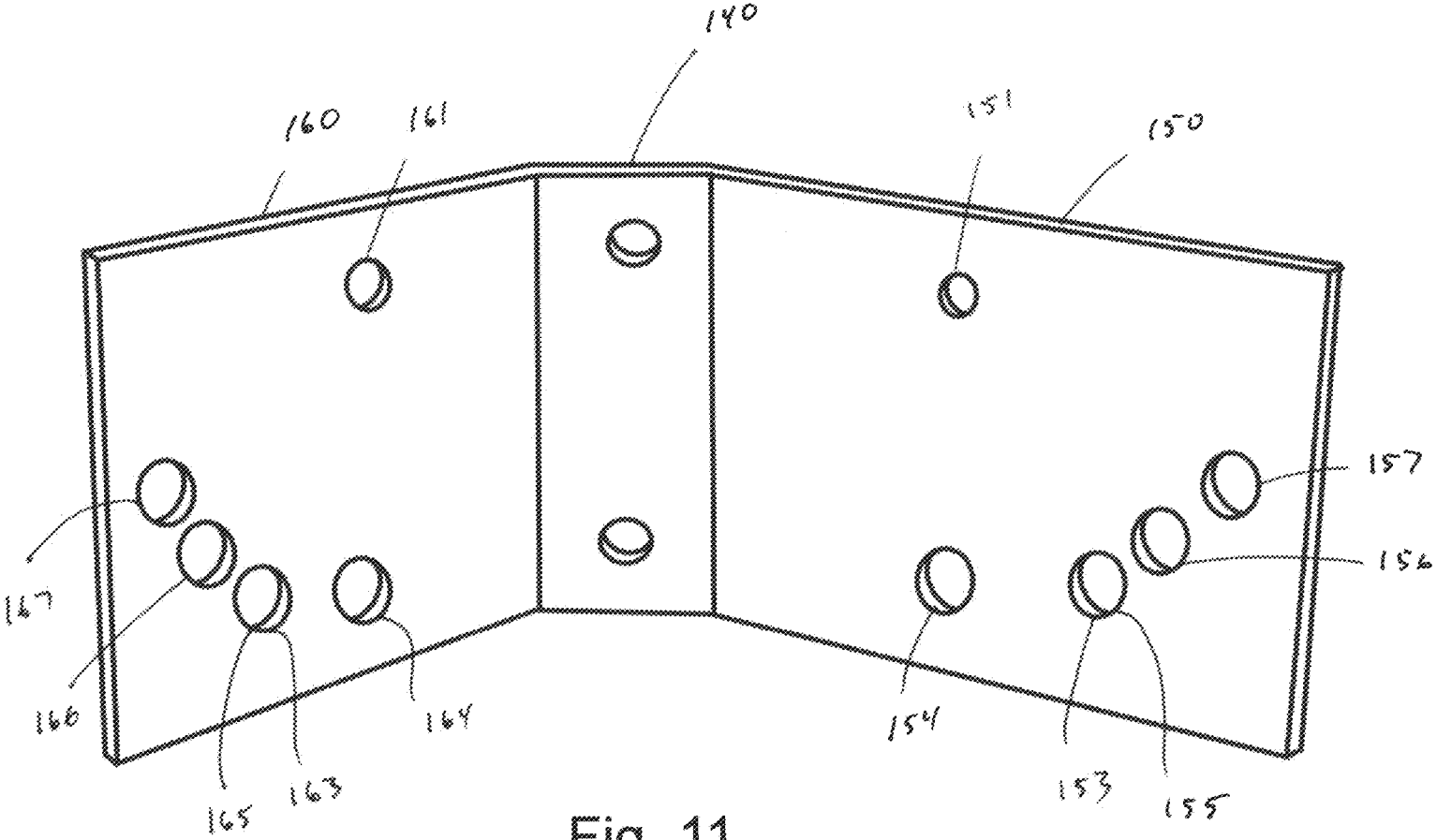
FIG. 11 is an isolation perspective view of a preferred second lower bracket.
Figure 18A:
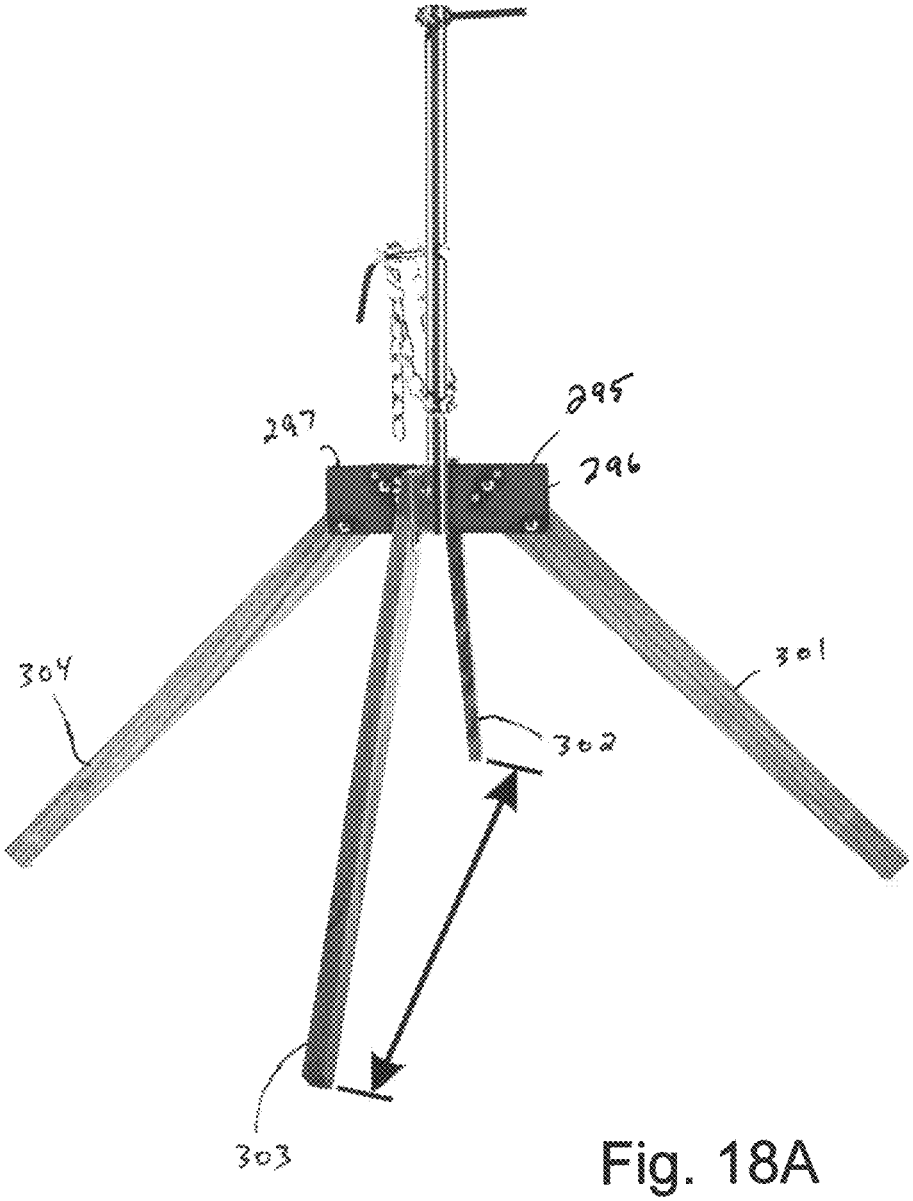
FIG. 18A is similar to FIG. 18, but illustrates the holes of the lower brackets in an alternative configuration.

Looking at FIGS. 7A and 18A, it is seen that the hole pattern can be rotated 180 degrees on the bracket without departing from the broad aspects of the present invention. In this regard, a base 295 with a first lower bracket 296 and a second lower bracket 287 are provided. This results in the fixed pivot connection point between the legs and the brackets being at an increased distance from the shaft central axis. Legs 301, 302, 303 and 304 are illustrated in FIG. 32. These legs 301-304 are similar to legs 200, 210, 220 and 230 but alternatively have the pivot hole and hole for the stud shown in an opposite arrangement to be compatible with the rotated hole pattern of the brackets.

Figure 33:
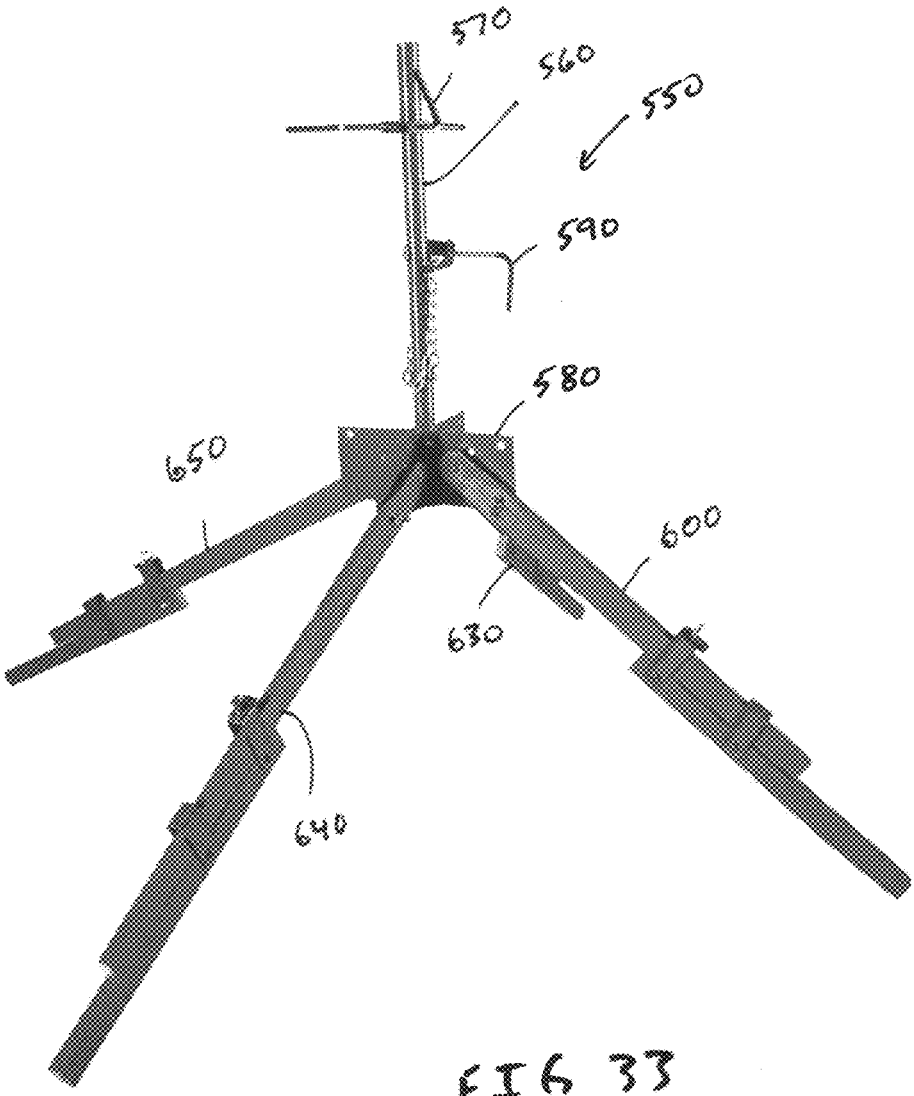
FIG. 33 is a perspective view of an alternative embodiment of the present invention showing legs in an extended mode.
Figure 34:
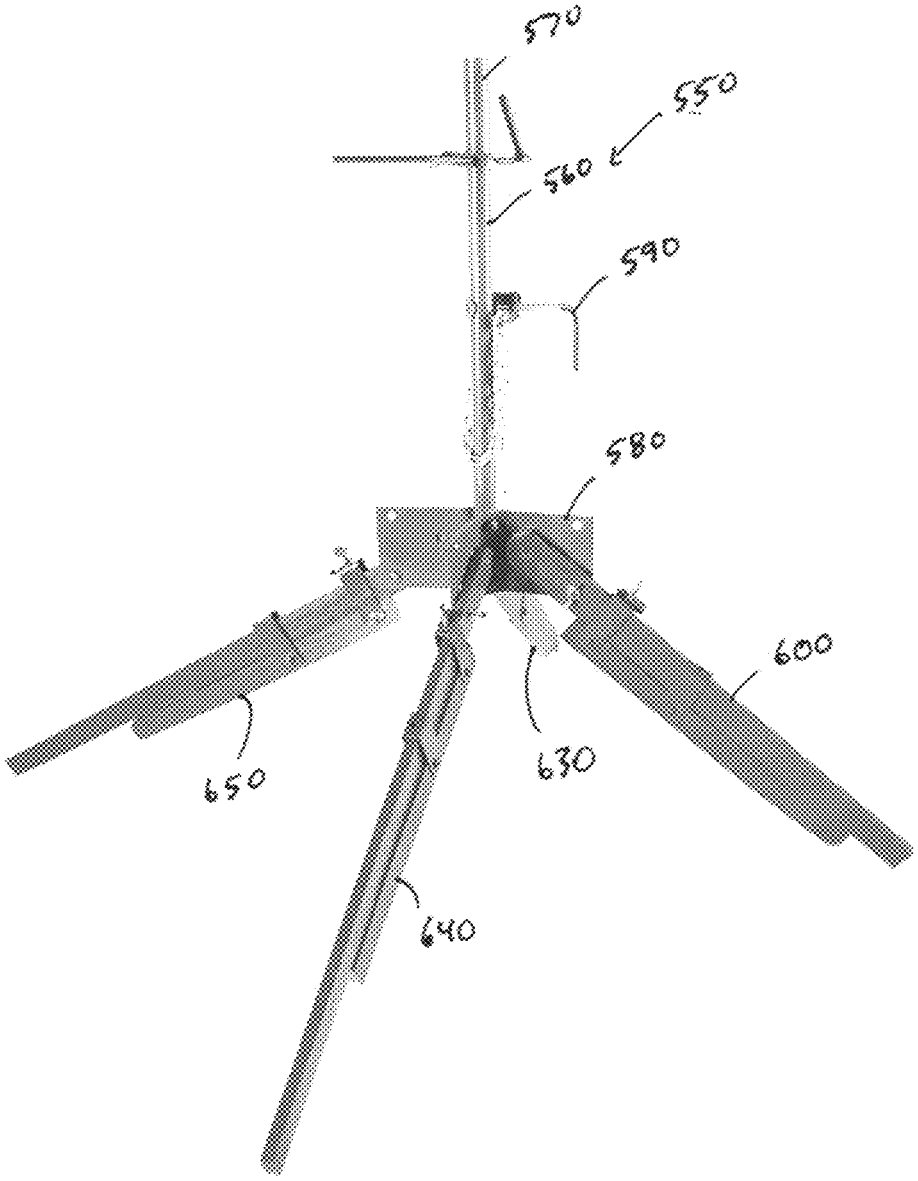
FIG. 34 is similar to FIG. 33 but shows the legs in a retracted position.
Figure 35:
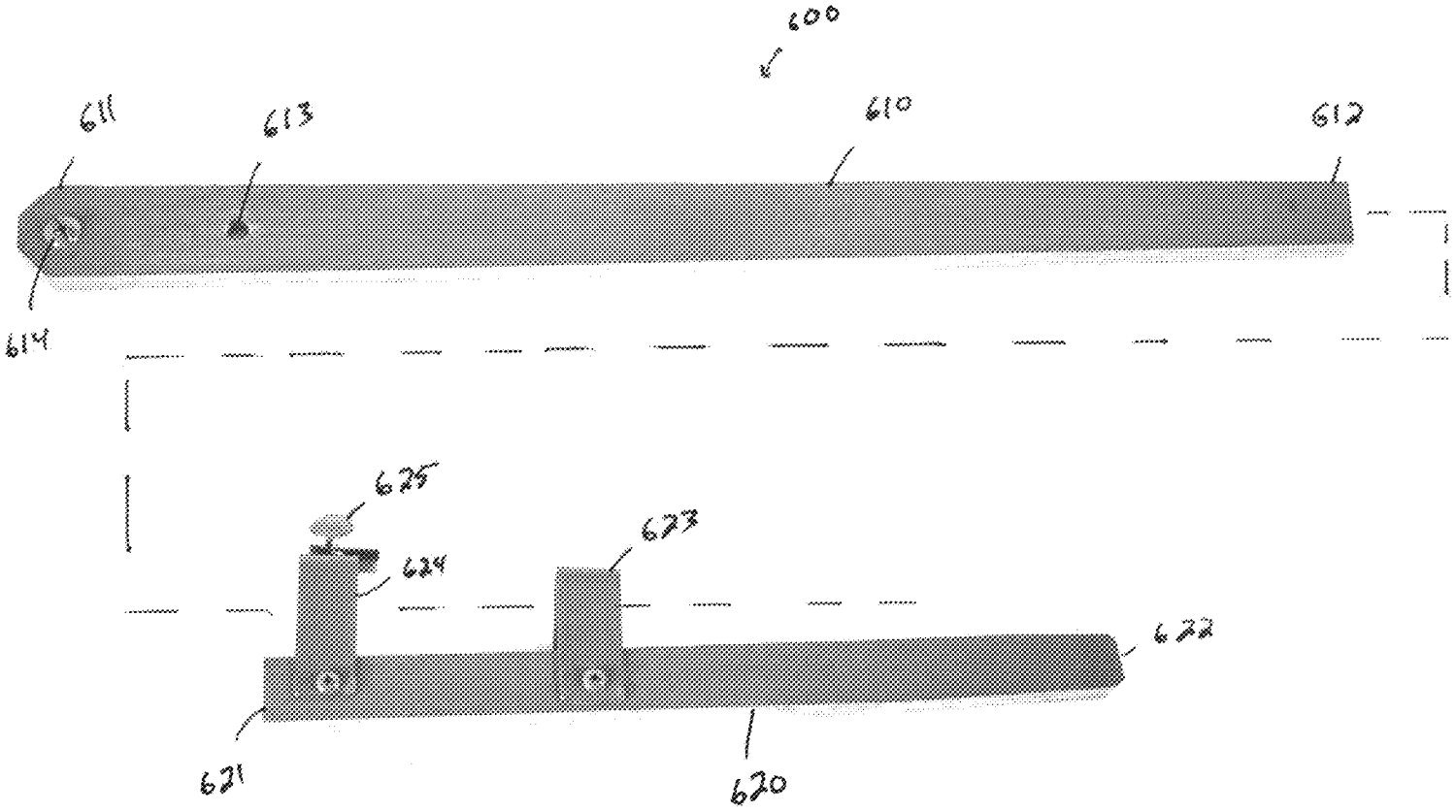
FIG. 35 is an exploded view of a leg of the alternative embodiment illustrated in FIG. 33.

In a further alternative embodiment as seen in FIGS. 33-35, the legs can have an adjustable length or can accommodate extensions to allow the stand to be used on an uneven surface or to add increased stability. A stand 550 is provided having a shaft 560, a top cradle 570, a bottom cradle 580 formed from a base, and a securement device 590. Legs 600, 630, 640 and 650 are provided. Legs 600, 630, 640 and 650 are extendable and retractable in an axial direction.

Leg 600 has a leg main section 610 and a leg extension 620. Leg main section 610 has a first end 611 and a second end 612. A stud 614 and a fastener 613 are near the first end 611. The leg extension 620 has a first end 621 and a second end 622. Two brackets 623 and 624 are provided. A lock 625 that can be formed of a thumb screw is used in connection with bracket 624.

The leg extension 620 is extendable from and retractable relative to the leg main section 610 along an extension axis. The brackets 623 and 624 surround the leg main section 610 and keep the extension 620 in an offset axial alignment (respective longitudinal axis of leg main section and extension are offset and parallel). The two pieces are infinitely adjustable relative to each other. When retracted, end 612 can engage the ground, floor or other surface. When extended, end 622 of the extension 620 can engage the ground, floor or other surface.

The fastener 613 joins the leg 600 to the base in a pivotable manner at a pivot point. The pivot point is between the stud 614 and the second end 612. In the regard, there is ample room between the pivot point and the shaft 560 of the stand 550 to provide clearance for the extension 620 as the leg 600 is rotated relative to the base to a storage position.

Legs 630, 640 and 650 are similar to leg 600.

Turning now to FIGS. 21-24, it is seen that an additional alternative embodiment of the present invention is illustrated. A stand 350 is provided having a shaft 360. An upper cradle 370 and a base 410 having a lower cradle 411 is also provided. A securing element 420 is further provided.

The upper cradle 370 has a holder 380. The holder 380 has a top piece 381 and a bottom piece 382. A central hole 383 passes through the top piece 381 and bottom piece 382 and is centrally aligned therewith. The top piece 381 is separated from the bottom piece 382 with two side walls 384. One sidewall 384 has a threaded sidewall hole 385 formed there through. The sidewall hole 384 is preferably generally parallel to the central hole 383. Two end holes 386 are also provided. The holder has a general box shape with openings on two sides and faces on four sides.

A lock 390 having a turning element 391 and a threaded element 392 is further provided. The threaded element 392 can be turned into and out of (i.e. translated) within sidewall hole 384 under operation of the turning element 391.

A cradle element 400 is further provided having a collar 401, a first side piece 402 and a second side piece 403. The cradle element 400 is preferably formed of a single rigid piece of material. The collar preferably has an elongated and closed loop shaped structure with parallel side walls having a width less than a width of the holder between sidewalls 384. The first and second side pieces 402 and 403 are divergent from each other, preferably generally at a right angle. Yet, it is appreciated that other angles of divergence could be used without departing from the broad aspects of the present invention.

In use, the collar 400 is inserted into an end hole 386 of the holder 380. Then the holder is placed upon the shaft by receiving the shaft 360 through the central hole 383. The shaft 360 also passes through the collar 401 of the cradle element 400. The threaded element 392 of the lock 390 is then received within hole 385 of the holder.

The top cradle is adjustable with at least three adjustments relative to the shaft 360. First, the cradle element 400 can move perpendicularly (in and out) relative to the shaft. The perpendicular adjustment is bound in both directions when the shaft engages one of the ends of the collar, respectively. In this regard, the shaft engaging the ends of the collar also prevents over travel and removal of the cradle element from the holder 380. Second, the holder 380 is vertically movable relative to the shaft via hole 383. Third, the holder can revolve about the shaft axis within hole 383 allowing for radial or rotatable adjustability. The lock 390 can fix the top cradle 370 in position relative to the shaft 360 by being turned into the holder until an end of the threaded element 392 abuts the collar 401 with sufficient force to make the collar likewise abut the shaft 360. These three adjustments allow for infinite adjustability within the travel limits of the cradle.

Looking now at FIG. 30, it is seen that the distance between the upper cradle 370 and lower cradle is set at a selected and adjustable distance.

Turning now to FIGS. 25-29, it is seen that a further preferred embodiment of a top cradle 470 is illustrated. The top cradle 470 has a holder 480, a lock 390 and a cradle element 400.

The holder 480 is preferably formed of a block 481 that is generally box shaped having six sides. A central hole 483, a side hole 485 and end holes 486 are formed in or through the block 481. The central hole 483 passes through the block and has a central hole diameter. The side hole 485 is threaded, and is open to both an outside of the block and to the central hole 483. The central hole 483 is aligned generally perpendicularly relative to the side hole 485. There are preferably two end holes 486 that extend all the way through the block 481 in directions generally perpendicular to both the central hole 483 and the side hole 485. The end holes 486 are preferably generally slot shaped, wherein they are wider than they are tall. One end hole 486 is open to both the central hole 483 and to the side hole 485. As an alternative, the holes 486 can be oversized relative the objects passing through the holes.

The lock 490 has a turning element 491 and a threaded element 492. The turning element 491 and threaded element 492 are preferably generally perpendicular to each other. The threaded element 492 is received within the side hole 485 and can be selectively turned into and out of the threaded side hole 485 under operation of the turning element 491.

The cradle element 500 is comprised of a fork 501. The fork 501 has a first side piece 502 having a first end and a divergent second end 503. The fork 501 further has a second side piece 504 having a first end and a divergent second end 505. The divergent ends 503 and 505 are generally oriented approximately 45 degrees from their respective first ends, and accordingly form a cradle opening approximately 90 degrees. The first and second side pieces are preferably formed of an integral piece of material and the connection between the sides can accomplished with a semi-circle shaped segment of the material, two right angle turns or other suitable manners of connection.

In use, the member forming the fork 501 is first inserted into end holes 486 of the holder 480. The fork 501 is then formed or bent to its divergent shape. Then the holder is placed upon the shaft by receiving the shaft through the central hole 483. The shaft also passes between the first and second side pieces 502 and 504, respectively, of the cradle element 500. The threaded element 492 of the lock 490 is then received within hole 485 of the holder.

The top cradle is adjustable with at least three adjustments relative to the shaft. First, the cradle element 500 can move perpendicularly relative to the holder 480. The perpendicular adjustment is bound in both directions (in one direction by the segment of material joining the first and second side pieces 402 and 404, and in the other direction by the divergent ends 403 and 405). In this regard, both over travel and removal of the cradle element from the holder 480 is prevented when the shaft is in place. Second, the holder 480 is vertically movable relative to the shaft via hole 483. Third, the holder can have rotatable adjustment as the holder revolves about the shaft axis within hole 383. The lock 490 can fix the top cradle 470 in position relative to the shaft by being turned into the holder until an end of the threaded element 492 abuts a side piece of the cradle element 400 with sufficient force to make the cradle element shift relative to the block 481 within holes 486 until it abuts the shaft. These three adjustments allow for infinite adjustability within the travel limits of the cradle.

Thus it is apparent that there has been provided, in accordance with the invention, a stand for holding an item in a vertical manner that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A stand comprising:
a shaft;
an upper cradle, said upper cradle having:
a holder with a central hole, said shaft passing through said central hole;
a lock, said lock comprising a turning element and a threaded element, said threaded element being selectably advanced through a side hole in said holder to lock a position of said upper cradle relative to the shaft; and
a cradle element;
a lower cradle;
a securement device, said securement device biasing an object into engagement with said upper cradle and said lower cradle; and
a plurality of legs.

2. The stand of claim 1 wherein said upper cradle and said lower cradle are separated by an adjustable distance.

3. The stand of claim 2 wherein said upper cradle is vertically, rotatably and perpendicularly adjustable relative to said shaft.

4. The stand of claim 1 wherein:
said plurality of legs comprises at least:
a first leg having a first leg distal end;
a second leg having a second leg distal end; and
a third leg having a third leg distal end; and
said first leg distal end, said second leg distal end and said third leg distal end have a center point;
said shaft has a shaft axis; and
said center point is offset from said shaft axis.

5. The stand of claim 4 wherein:
said plurality of legs further has a fourth leg;
two of said first leg, said second leg, said third leg and said fourth leg have a first leg length; and
two of said first leg, said second leg, said third leg and said fourth leg have a second leg length.

6. The stand of claim 5 wherein:
said first leg has a first leg proximal end pivotally connected to said lower cradle;

said second leg has a second leg proximal end pivotally connected to said lower cradle;

said third leg has a third leg proximal end pivotally connected to said lower cradle; and said fourth leg has a fourth leg proximal end pivotally connected to said lower cradle.

7. The stand of claim 6 wherein said stand has a storage position and at least one deployed position.

8. The stand of claim 7 wherein said stand has two storage positions and three deployed positions.

9. The stand of claim 1 wherein said securement device is between said upper cradle and said lower cradle on said shaft.

10. The stand of claim 1 wherein said lower cradle is formed of a first lower bracket and a second lower bracket, said first lower bracket and said second lower bracket being fixed in position relative to said shaft.

11. The stand of claim 1 wherein each of said plurality of legs has an adjustable length.

12. A stand for supporting an object, said stand comprising:

a shaft with a longitudinal axis;

an upper cradle;

a lower cradle; and a plurality of legs each having a respective distal end, said respective distal end of each of said plurality of legs collectively defining a leg center point when said plurality of legs are positioned to a deployed position, wherein said leg center point is offset from said longitudinal axis when said plurality of legs are positioned in said deployed position and the object is positioned by said upper cradle and said lower cradle along an axis in line with said leg center point.

13. The stand of claim 12 wherein said plurality of legs has a first leg, a second leg, a third leg and a fourth leg.

14. The stand of claim 13 wherein:

said stand has a lower cradle that is part of a base;

said first leg, said second leg, said third leg and said fourth leg are each attached to said base;

two of said first leg, said second leg, said third leg and said fourth leg have a first leg length; and two of said first leg, said second leg, said third leg and said fourth leg have a second leg length.

15. The stand of claim 12 wherein:

said deployed position is a first deployed position;

each of said plurality of legs also has a second deployed position; and each of said plurality of legs also has a storage position.

16. A stand comprising:

a shaft;

an upper cradle that is vertically, rotatably and perpendicularly adjustable relative to said shaft, said upper cradle comprising:

a holder that is a unitary piece having a central hole with a fixed dimension, said shaft passing through said central hole;

a cradle element; and a lock, said lock comprising a turning element and a threaded element, said threaded element being selectably advanced through a side hole in said holder to lock a position of both of said holder and said cradle element; and a lower cradle.

17. The stand of claim 16 wherein:

said lower cradle is part of a base;

said stand further comprises a first leg, a second leg, a third leg and a fourth leg;

said first leg, said second leg, said third leg and said fourth leg are each pivotally connected to said base a distance offset from said shaft.

18. The stand of claim 17 wherein:

said shaft has a shaft axis;

said first leg has a first leg distal end;

said second leg has a second leg distal end;

said third leg has a third leg distal end;

said fourth leg has a fourth leg distal end;

said first leg distal end, said second leg distal end, said third leg distal end and said fourth leg distal end define a center point when each is in a deployed position; and said center point is offset from said shaft axis.

19. A stand comprising:

a shaft;

an upper cradle;

a lower cradle;

a securement device; and a plurality of legs, said plurality of legs comprises at least:

a first leg having a first leg distal end;

a second leg having a second leg distal end; and a third leg having a third leg distal end; wherein said first leg distal end, said second leg distal end and said third leg distal end have a leg center point;

said shaft has a shaft axis;

said leg center point is offset from said shaft axis;

said securement device biases an object into engagement with said upper cradle and said lower cradle so that the object is held along an axis that is aligned with said leg center point.

* * * * *